US008395501B2

(12) United States Patent
Gonzales

(10) Patent No.: US 8,395,501 B2
(45) Date of Patent: Mar. 12, 2013

(54) DYNAMIC ALARM SENSITIVITY ADJUSTMENT AND AUTO-CALIBRATING SMOKE DETECTION FOR REDUCED RESOURCE MICROPROCESSORS

(75) Inventor: Eric V. Gonzales, Aurora, IL (US)

(73) Assignee: Universal Security Instruments, Inc., Owings Mills, ME (US)

( * ) Notice: Subject to any disclaimer, the term of this patent is extended or adjusted under 35 U.S.C. 154(b) by 183 days.

(21) Appl. No.: 13/043,053

(22) Filed: Mar. 8, 2011

(65) Prior Publication Data

US 2012/0126975 A1 May 24, 2012

Related U.S. Application Data

(60) Provisional application No. 61/416,678, filed on Nov. 23, 2010.

(51) Int. Cl.
*G08B 21/00* (2006.01)

(52) U.S. Cl. .... 340/540; 340/629; 340/632; 340/636.14

(58) Field of Classification Search ..... 340/506, 340/517, 521, 522, 540, 573.7, 577–579, 340/587–589, 600, 628–632, 636.11–636.15
See application file for complete search history.

(56) References Cited

U.S. PATENT DOCUMENTS

| | | | | |
|---|---|---|---|---|
| 5,117,219 | A | 5/1992 | Tice et al. | |
| 5,260,687 | A * | 11/1993 | Yamauchi et al. | 340/522 |
| 5,369,397 | A * | 11/1994 | Wong | 340/632 |
| 5,376,924 | A | 12/1994 | Kubo et al. | |
| 5,530,433 | A | 6/1996 | Morita | |
| 5,539,389 | A | 7/1996 | Bystrak et al. | |
| 5,543,777 | A | 8/1996 | Vane et al. | |
| 5,546,074 | A | 8/1996 | Bernal et al. | |
| 5,552,765 | A | 9/1996 | Vane et al. | |
| 5,557,262 | A | 9/1996 | Tice | |
| 5,612,674 | A | 3/1997 | Tice | |
| 5,627,515 | A | 5/1997 | Anderson | |
| 5,736,928 | A | 4/1998 | Tice et al. | |
| 5,764,142 | A | 6/1998 | Anderson et al. | |
| 5,798,701 | A | 8/1998 | Bernal et al. | |
| 5,831,524 | A | 11/1998 | Tice et al. | |
| 6,107,925 | A | 8/2000 | Wong | |
| 6,150,935 | A | 11/2000 | Anderson | |
| 6,166,647 | A | 12/2000 | Wong | |
| 6,166,648 | A | 12/2000 | Wiemeyer et al. | |
| 6,222,456 | B1 | 4/2001 | Tice | |
| 6,320,501 | B1 | 11/2001 | Tice et al. | |
| 6,861,951 | B2 | 3/2005 | Reghetti et al. | |
| 6,948,352 | B2 | 9/2005 | Rabbett et al. | |
| 6,975,223 | B1 | 12/2005 | Mladen et al. | |

(Continued)

OTHER PUBLICATIONS

Muller, H. C., et al., "New Approach to fire Detection Algorithms Based on the Hidden Markov Model," International Conference on Automatic Fire Detection "AUBE '01", 12th Proceedings, National Institute of Standards and Technology, Mar. 25-28, 2001, pp. 129-138.

Bahrepour, M., et al, "Automatic Fire Detection: A Survey From Wireless Sensor Network Perspective," Pervasive Systems Group, University of Twente.

(Continued)

*Primary Examiner* — Anh V La

(74) *Attorney, Agent, or Firm* — Cahn & Samuels, LLP

(57) ABSTRACT

A hazardous condition detection system with a sensor package employing a reduced resource microprocessor capable of dynamic alarm sensitivity adjustment having volatile and non-volatile memory which receives periodic raw sensor readings from the sensor package and preprocesses each received periodic raw sensor reading by employing at least three distinctive filtering constants which are compared to alarm thresholds stored in memory to generate an alarm condition signal when ionization levels in the ambient environment exceed stored thresholds.

20 Claims, 12 Drawing Sheets

U.S. PATENT DOCUMENTS

| | | | |
|---|---|---|---|
| 7,075,445 | B2 | 7/2006 | Booth et al. |
| 7,076,403 | B2 | 7/2006 | Tice |
| 7,142,105 | B2 | 11/2006 | Chen |
| 7,154,402 | B2 | 12/2006 | Dayoub |
| 7,161,481 | B2 | 1/2007 | Turner |
| 7,170,418 | B2 | 1/2007 | Rose-Pehrsson et al. |
| 7,218,708 | B2 | 5/2007 | Berezowski et al. |
| 7,221,260 | B2 | 5/2007 | Berezowski et al. |
| 7,227,450 | B2 | 6/2007 | Garvy et al. |
| 7,242,292 | B2 | 7/2007 | Berezowski et al. |
| 7,280,039 | B2 | 10/2007 | Ito et al. |
| 7,307,539 | B2 | 12/2007 | Harvey et al. |
| 7,327,247 | B2 | 2/2008 | Tice |
| 7,649,450 | B2 | 1/2010 | Campion, Jr. et al. |
| 7,804,402 | B2 | 9/2010 | Lang et al. |
| 2002/0118116 | A1 | 8/2002 | Tice et al. |
| 2003/0004426 | A1 | 1/2003 | Melker et al. |
| 2003/0020617 | A1 | 1/2003 | Tice et al. |
| 2006/0192670 | A1 | 8/2006 | Tice |
| 2006/0212570 | A1 | 9/2006 | Aritsuka et al. |
| 2007/0110221 | A1 | 5/2007 | Berezowski et al. |
| 2007/0152809 | A1 | 7/2007 | Berezowski et al. |
| 2007/0188337 | A1 | 8/2007 | Mi et al. |
| 2008/0068267 | A1 | 3/2008 | Huseth et al. |
| 2008/0122696 | A1 | 5/2008 | Huseth et al. |
| 2008/0180258 | A1 | 7/2008 | Lang et al. |
| 2009/0009345 | A1 | 1/2009 | Conforti |

OTHER PUBLICATIONS

Bahrepour, M., et al., "Use of AI Techniques for Residential Fire Detection in Wireless Sensor Networks," AIAI-2009 Workshops Proceedings, Pervasive Systems Research Group, Twente University, the Netherlands, pp. 311-321.

Gottuk, D., et al., "Advaned Fire Detection Using Multi-signature Alarm Algorithms," Hughes Associates, Inc., Baltimore, MD, pp. 140-149.

Huckaby, E., et al., "Computational fluid dynamics modeling of the operation of a flame ionization sensor," 5th US combustion Meeting, Organized by the Western States Section of the Combustion Institute and Hosted by the University of California at San Diego, Mar. 2007.

Jones, W., "A Review and Implementation of Algorithms for Fast and Reliable Fire Detection," National Institute of Standards and Technology, Technology Administration, U.S. Department of Commerce, NISTIR 7060, Oct. 2003.

Roby, R, et al., "A Smoke Detector Algorithm for Large Eddy Simulation Modeling," NIST GCR 07-911, National Institute of Standards and Technology, Technology Administration, U.S. Department of Commerce, Jul. 2007.

Lazarus, Ron et al., "USI Proposal and Quotation, a Presentation to The Home Depot," May 27, 2009, USI Electric, Chicago, IL., USA.

Haigh, Phil et al., "USI Product Presentation, Home Safety Products-Alarms at the National Hardware Show," May 6, 2009, USI Electric, Chicago, IL., USA.

* cited by examiner

DYNAMIC ALARM SENSITIVITY ADJUSTMENT AND AUTO-CALIBRATING SMOKE DETECTION FOR REDUCED RESOURCE MICROPROCESSORS

PRIORITY CLAIM

This application claims the benefit of U.S. Provisional Application Ser. No. 61/416,678 filed on Nov. 23, 2010 which is incorporated herein by reference.

I. TECHNICAL FIELD

This invention relates to the field of hazardous condition detectors in general and specifically to an improved system and method for hazardous condition detection using a reduced resource microprocessor for ambient condition compensation.

II. BACKGROUND OF INVENTION

Fire detection devices such as smoke detectors and/or gas detectors are generally employed in structures or machines to monitor the environmental conditions within the living area or occupied compartments of a machine. These devices typically provide an audible or visual warning upon detection of a change in environmental conditions that are generally accepted as a precursor to a fire event or other hazardous condition.

Typically, smoke detectors include a smoke sensing chamber, exposed to the area of interest. The smoke detector's smoke sensing chamber is coupled to an ASIC or a microprocessor circuit. The microprocessor or the ASIC performs the signal processing functions. The smoke sensor samples the qualities of the exposed atmosphere and when a predetermined change in the atmosphere of the exposed chamber is detected by the microprocessor or ASIC, an alarm is sounded.

There are two types of smoke sensors that are in common use: optical or photoelectric type smoke sensors and ionization type smoke sensors. Photoelectric-based detectors are based on sensing light intensity that is scattered from smoke particles. Light from a source (e.g. LED) is scattered and sensed by a photosensor. When the sensor detects a certain level of light intensity, an alarm is triggered.

Ionization-type smoke detectors are typically based on a radioactive material that ionizes some of the molecules in the surrounding gas environment. The current of the ions is measured. If smoke is present, then smoke particles neutralize the ions and the ion current is decreased, triggering an alarm.

The ionization smoke detectors that are currently available in the market are very sensitive to fast flaming fires. This type of fire produces considerable energy and ionized particles, which are easily detected by an ionization sensor.

Smoldering fires most commonly result from cigarette ignition of materials found in homes such as sofas and beds. A smoldering fire typically produces cold smoke particles of which only a small portion is ionized. Because ionization technology focuses on detection of ionized particles, smoldering fire detection with an ionization sensor is typically inconsistent.

The recent advent of reliable microprocessors at a relatively low cost has led to the incorporation of microprocessor technology into the hazardous condition detector field. Attempts to achieve consistent and reliable detection of different types of fire events has led designers to combine various sensor technologies, ionization, photoelectric, optical gas or chemical based sensors into a single unit or system, and employ the signal processing abilities of microprocessors to simultaneously monitor the plurality of sensors. However the combination of various types of sensors, having various signal characteristics tends to be computationally intensive and somewhat inefficient.

Such a system is disclosed in U.S. Pat. No. 7,327,247 in which outputs from a plurality of different types of ambient condition sensors are cross-correlated to adjust a threshold value for a different, primary, sensor. The cross-correlation processing can be carried out locally in a detector or remotely. To minimize false alarming, the alarm determination may be skipped if the output from the primary sensor does not exhibit at least a predetermined variation from an average value thereof. This cross-correlation type of processing used in these combination systems can be very computationally inefficient, thus requiring significant computing resources. In addition, these combination type systems are complex and rather expensive, when one considers the expensive involved in using various sensors, and in employing one or more microprocessors having the required computing power resident thereon. Heretofore, this approach is typical of the current solutions for consistent detection of flaming and smoldering fires.

Other approaches to achieve adequate detection of fires with low false alarm rates incorporate various filtering methods, which are typically used to prevent false or nuisance alarms. These conventional methods typically are also rather inefficient in that they either unnecessarily delay the detection of a fire event, or they require unnecessary processing of the signal. This delays fire event detection and significantly increases the system's power consumption. The requirement for more computing power resident on the chip also increases the expense of the microprocessor and/or ASIC, and ultimately the costs of the system.

Such a system is disclosed in U.S. Pat. No. 5,736,928, which is directed to an apparatus and a method to pre-process an output signal from an ambient condition sensor. The preprocessing removes noise pulses which are not correlated with an ambient condition being sensed. The preprocessing is carried out by comparing the present output value to a prior output value and selecting a minimum value there between. The apparatus and methods incorporate storage for two prior values and the present output value is compared to the two prior values. A minimum or a maximum of the three values is selected.

Additional processing is typically carried out by comparing the present output value to a nominal expected clear air output value, and if the present value exceeds the nominal expected output value, a minimum is selected among the present output value and one or more prior values. If the present output value is less than the nominally expected value, a maximum is selected from among the present output value and one or more prior output values. This approach is computationally inefficient in that the filtering methods used unnecessarily remove relevant signal information which can delay the system's response to a fire event.

Other systems employ multiple filtering operations. One such system is disclosed in U.S. Pat. No. 5,612,674, which describes a noise immune detection system having a plurality of detectors that generate respective indicia representative of adjacent ambient conditions. A communications link extends between the detectors. A control element is coupled to the link to receive and process the indicia and to adjust an alarm threshold level in response to noise levels in the system. Respective indicia are filtered twice by the control element. In the presence of noise, as reflected in relative values of the filtered values of the indicia, the threshold value is automatically increased. This approach tends to be inefficient and unnecessarily expends processing resources. This solution is also rather inefficient in that it requires computational intensive multiple filtering iterations applied to a previously filtered signal.

Smoke and gas sensors can be affected by temperature, humidity, and dust particles. One or a combination of these ambient environmental factors can cause a smoke or gas detector to false alarm.

Traditional methods of compensating for ambient environmental factors typically include adjusting the output of the sensors. Such an approach is disclosed in U.S. Pat. No. 5,798,701, which is directed to a self-adjusting, self-diagnostic smoke detector. The detector includes a microprocessor-based alarm control circuit that periodically checks the sensitivity of a smoke sensing element to a smoke level in a spatial region. The alarm control circuit and the smoke sensor are mounted in a discrete housing that operatively couples the smoke sensor to the region. The microprocessor implements a routine stored in memory by periodically determining a floating adjustment that is used to adjust the output of the smoke sensing element and of any sensor electronics to produce an adjusted output for comparison with an alarm threshold. The floating adjustment is not greater than a maximum value or less than a minimum value. Except at power-up or reset, each floating adjustment is within a predetermined slew limit of the immediately preceding floating adjustment. The floating adjustment is updated with the use of averages of selected signal samples taken during data gathering time intervals having a data gathering duration that is long in comparison to the smoldering time of a slow fire. The adjusted output is used for self-diagnosis.

These self adjusting systems are not optimized for the detection of traditional fires as well as smoldering fire events with a single sensor, nor do they employ multiple fire event specific thresholds from which the processor may select. In addition, the prior art systems tend to employ solutions that are computationally inefficient, expending more of the systems signal processing resources thus requiring the use of more powerful and expensive microprocessors to maintain the same level of flexibility for a system designer.

Thus there exists a need for a computationally efficient method to achieve consistent detection of fast flaming fires as well as smoldering fires using a single ionization type smoke sensor. A system and method that employs an algorithm that is optimized to lower the demands on the computing power resident on the microprocessor employed in a system using less expensive sensors and lower power microprocessors is needed.

III. SUMMARY OF INVENTION

It is an object of the current invention is to provide a computationally efficient method to achieve consistent detection of fast flaming fires as well as smoldering fires using a single ionization type smoke detector.

It is another object of the invention to provide a system that employs an algorithm that is optimized to lower the demands on the computing power resident on the microprocessor.

It is yet another object of the invention to provide a system that employs an algorithm that is optimized to lower the microprocessor's energy consumption.

It is another object of the invention to provide a system that provides consistent detection of fast flaming fires and smoldering fires that able to use less expensive microprocessors.

It is still another object of the current invention to provide a system and method for detecting hazardous conditions that employs a pre processing step incorporating optimized comparisons to lower the demands on the microprocessor.

It is yet another object of the current invention to provide a system and method for detecting hazardous conditions that compensates for environmental changes in the monitored space.

It is still another object of the current invention to provide a system and method for detecting hazardous conditions that selects and employs an alarm threshold optimized to detect a particular type of fire profile.

It is yet another object of the current invention to provide a system and method for detecting hazardous conditions that is resistant to false alarms while maintaining good response to a fire event.

Certain of these and other objects are satisfied by a microprocessor controlled hazardous condition detection system including a housing containing a sensor package; the sensor package contains sensors exposed to the ambient environment. The sensors take periodic readings of predetermined environmental conditions. The disclosed system also includes an alarm means coupled to the sensor package through a microprocessor having volatile and non-volatile memory. The microprocessor employs a computationally efficient algorithm optimized to minimize the required floating point operations and to lessen the computing power demands on the microprocessor and memory.

The non-volatile memory features a plurality of alarm threshold differential values stored therein and a designated clean air value or clean air reading is stored in the non-volatile memory as well. Upon system power-up, the clean air reading is loaded into the volatile memory. An alarm threshold differential value is selected and used to generate an alarm threshold value. The microprocessor receives periodic readings of predetermined environmental conditions from the sensor package and preprocesses each received signal generating at least three conditioned signals for each received signal. The conditioned signals are generated by applying at least three different levels of signal filtering to the received signals, generating a set of conditioned signals representative of the periodic reading received. Each conditioned signal in the set has a different signal to noise ratio optimized for a different signal processing task. Each set of conditioned signals is stored in the volatile memory. Based on comparisons made during the signal processing, the microprocessor selects a stored alarm threshold differential value from the non-volatile memory from the plurality of stored alarm thresholds differential values and generates an optimized threshold value to detect a particular fire profile suggested by the monitored conditions. The optimized threshold value is loaded into non-volatile memory and employed as the alarm threshold.

The microprocessor also adjusts the generated alarm threshold value to compensate for gradual changes in the ambient conditions over time by shifting the alarm threshold loaded into the non volatile memory by a small amount based on the calculated difference in the default clean air alarm threshold and the environmental readings accumulated over a period of several hours.

Also disclosed is a hazardous condition detector that is optimized to readily detect smoldering as well as traditional fast fires using only a single ionization type sensor. This technology is an improvement over existing photoelectric detector technology by providing a sensor possessing enhanced detection capabilities for smoldering fires. Performance of the disclosed invention corresponds to a dual technology alarm system incorporating separate photo and ion sensors while using only the more economical ionization sensor.

The disclosed invention employs microprocessor control to analyze the character/type of smoke by tracking the rate of change of the sensor signal over a predetermined time period. The rate of change in the ionization levels will be different depending on the type of fire event. Smoldering fires yield a slow but persistent change in ionization signal, and fast flaming fires typically produce a rapid measured signal change. The disclosed invention pre-processes the received sensor signal, generating at least three conditioned signals representative of the received sensor signal. Each conditioned signal is optimized for a particular signal processing comparison, and is selected and employed by the microprocessor during signal processing to optimize the thresholds employed to define an alarm event.

The disclosed invention employs a plurality of distinct alarm thresholds for different types of fire events or fire profiles. Employing periodic sampling, and using a microprocessor to evaluate the rate of ionized particle change, and selecting a particular alarm threshold from the plurality of available thresholds based on the characteristics of the of ionized particle change, enable the system to efficiently detect both types of fires with ionization technology.

Disclosed is a microprocessor controlled hazardous condition detection system having a housing containing a sensor package containing a hazardous condition sensor exposed to the ambient environment. The sensor exposed to the ambient environment takes periodic readings of the ambient environment in proximity to the system. The system also includes an alarm means, in the form of an alarm circuit, or ASIC coupled to the sensor package, both of which are preferably disposed in the housing. A microprocessor is coupled to the alarm circuit. The microprocessor includes a memory storage device with volatile and non-volatile memory. The non-volatile memory contains a clean air reading and a plurality of alarm thresholds differential values. Each of the plurality of alarm thresholds differential values is associated with a predetermined set of sensor readings indicative of a hazardous condition in the ambient environment or a precursor to a hazardous event.

The microprocessor receives periodic raw sensor readings from the sensor package, and preprocesses each received periodic raw sensor reading employing at least three distinctive filtering constants to generate a set of at least three conditioned sensor readings from each raw sensor reading. Over time, the microprocessor accumulates a set of conditioned sensor readings in the volatile memory, and selects an alarm threshold differential value from the plurality of alarm thresholds differential values stored in the non-volatile memory based on the rate of change of the conditioned sensor readings in a select subset of accumulated conditioned sensor readings generated from a common filtering constant. The microprocessor generates an alarm threshold from the selected alarm threshold differential value and applies the generated alarm threshold.

The pre-processing algorithm employed by embodiments of the disclosed system is streamlined, computationally efficient and is optimized to require fewer floating point operations than previous systems. This feature significantly reduces the demands placed on the system's available processing power and memory and makes possible the application of the optimization algorithm in microprocessors that have reduced processing power and are therefore less expensive. The reduced processing power and memory demands have the added benefit of reducing the microprocessor energy use.

In at least one of the disclosed embodiments of the hazardous detection system, the microprocessor preprocesses each periodic sensor reading received from the sensor package according to the relation: $V_{xot}=1/N_x*\Sigma[N_x*V_o+(V_{it}-V_{xot-1})]$ from $t_n$ to t, where $V_{xot}$ is the new conditioned sensor reading, $N_x$ s a filtering constant, $V_o$ is the clean air reading (starting with the factory set reading), $V_{it}$ is the new raw sensor reading taken at time t, and $V_{xot-1}$ is the previously generated conditioned signal at time t-1, employing at least 3 distinctive filtering constants to generate a set of at least 3 conditioned sensor readings from each raw sensor reading received.

Also disclosed is a method for selecting an alarm threshold for a hazardous condition detector including the method steps of associating a first alarm threshold differential value with a first predetermined set of ionization levels, and associating a second alarm threshold differential value with a second predetermined set of ionization levels and generating a first alarm threshold value from the first alarm threshold differential value. The method also includes designating the first generated alarm threshold value as the current alarm threshold and receiving periodic raw sensor readings of the ionization level in the ambient environment from a sensor package.

The method further includes preprocessing each received periodic raw sensor reading, and generating a set of conditioned sensor readings for each received periodic raw sensor reading, and accumulating a plurality of sets of the generated conditioned sensor readings. The method includes generating a first subset of conditioned sensor readings by selecting a first conditioned sensor reading from each of a plurality of accumulated sets of conditioned sensor readings.

In addition the method includes generating a second subset of conditioned sensor readings by selecting a second conditioned sensor reading from each of a plurality of accumulated sets of conditioned sensor readings, and comparing the second subset of the conditioned sensor readings with the second predetermined set of ionization levels associated with the second alarm threshold differential value with a microprocessor. If the second subset of conditioned sensor readings are within the ionization levels specified in the second predetermined set of ionization levels the microprocessor selects the second alarm threshold differential value, generates a second alarm threshold value from the selected second alarm threshold differential value, and designates the second alarm threshold value as the current alarm threshold.

The method also includes comparing the current alarm threshold with a third conditioned sensor reading selected from the newest set of conditioned sensor readings; and designating an alarm event if the third conditioned sensor reading is in violation of the current alarm threshold.

The method also includes designating the first alarm threshold value as the current alarm threshold if the newest conditioned sensor readings from the second subset of conditioned sensor readings is less than the current alarm threshold value but greater than or equal to the preceding conditioned sensor reading in the second subset.

For definitional purposes and as applicable the term "threshold" is the level i.e., a voltage or current level returned by an environmental sensor, at which a hazardous alarm condition is inferred and an alarm would be initiated. Typically the alarm threshold value or $V_{ALARM}$ is generated by computing the difference between the alarm threshold differential value and the conditioned signal $V_{1NEW}$. The threshold may be subsequently adjusted by a small amount to compensate for changes in the environmental conditions.

The term "compensated alarm threshold" is the alarm threshold value including the compensation shift and is generated by computing the difference between the alarm threshold differential value and the conditioned signal $V_1$.

As used herein the term "compensation shift" is typically the small value by which the alarm threshold may be adjusted to compensate for temperature, humidity or other changes in the ambient environment.

The term "alarm threshold differential value" is typically a constant value defining the delta between the clean air reading and the alarm threshold value. The alarm threshold differential value is used to generate the alarm threshold.

As used herein the term "clean air value" is the sensor reading, typically a voltage and/or current level, set and associated with the monitored space at 0% obscuration, at 100 MIC or in the absence of smoke.

The term "CEV" is the Central Electrode Voltage. This voltage is the voltage (V) representative of the signal produced by the ionization sensor contained in the sensor package at a point in time and varies based on the level of ionized particles in the smoke chamber.

The term "fire profile" is a set of environmental readings that are indicative of, a precursor to, or are otherwise associated with a particular type of fire event.

The term "signal profile" is a set of sensor signals that are indicative of, a set of environmental readings that are indicative of a particular fire profile.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

As used herein "connected" includes physical engagement, whether direct or indirect, permanently affixed or adjustably mounted. Thus, unless specified, "connected" is intended to embrace any operationally functional connection.

IV. BRIEF DESCRIPTION OF THE DRAWINGS

In order to describe the manner in which the invention can be obtained, a more particular discussion of the invention briefly set forth above will be rendered by reference to specific embodiments thereof which are illustrated in the appended drawings. Understanding that these drawings depict only typical embodiments of the invention, and are not, therefore, to be considered to be limiting of its scope, the invention will be described and explained with additional specificity and detail through the use of the accompanying drawings.

V. DETAILED DESCRIPTION OF THE INVENTION

Various embodiments are discussed in detail below. While specific implementations of the disclosed technology are discussed, it should be understood that this is done for illustration purposes only. A person skilled in the relevant art will recognize that other components and configurations may be used without departing from the spirit and scope of the invention.

Figure 1:
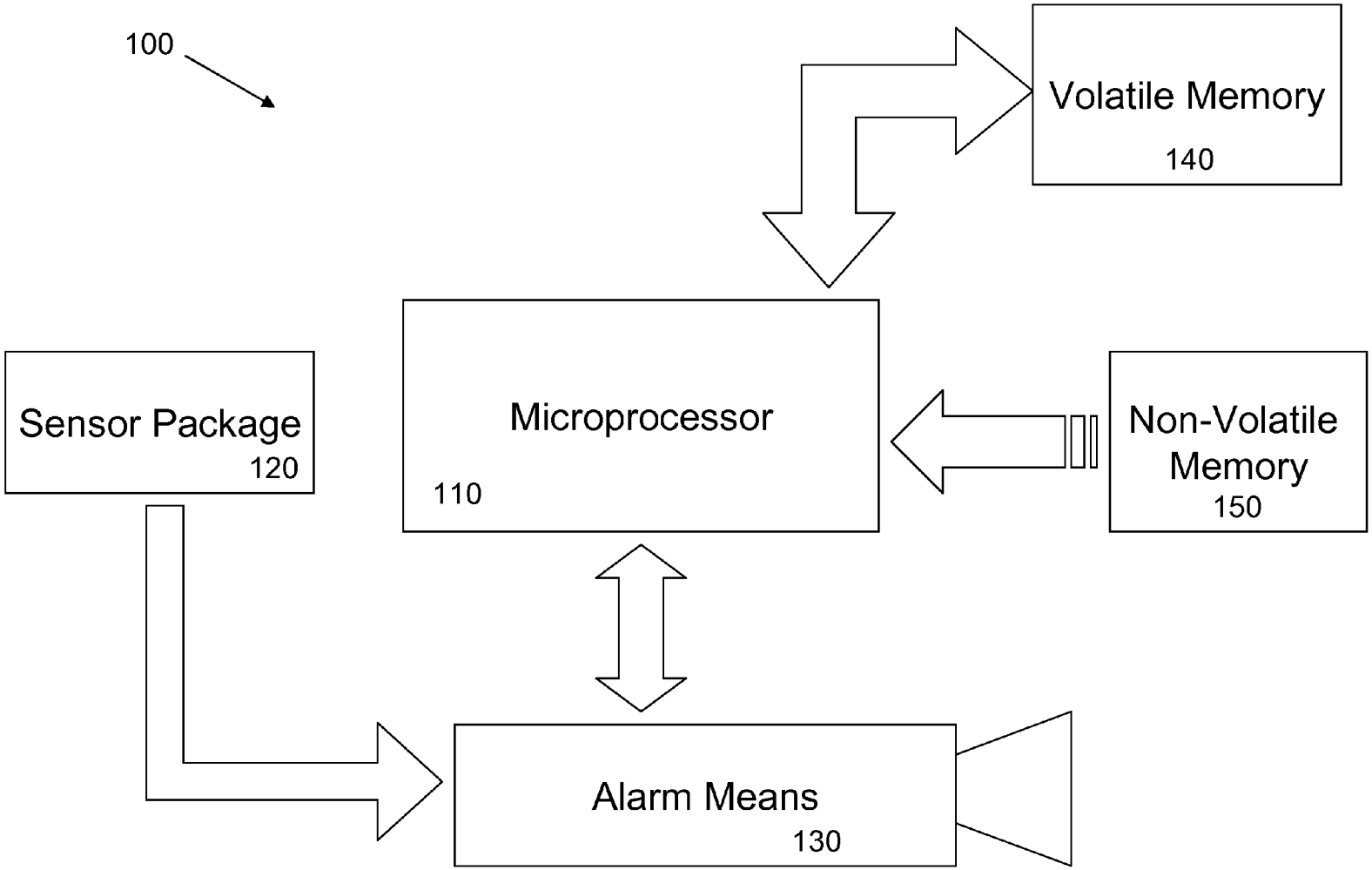
FIG. 1 is a block diagram of an exemplarily embodiment of a microprocessor controlled hazardous condition detection system employing the disclosed ambient condition compensation feature.

Referring now to the Figures, wherein like reference numbers denote like elements, FIG. 1 illustrates an exemplarily embodiment of a microprocessor controlled hazardous condition detection system employing the disclosed ambient condition compensation feature. As shown in FIG. 1, the hazardous condition detection system 100 features a housing 101 containing a sensor package 120. The sensor package 120 contains at least one sensor that is exposed to the ambient environment and takes periodic readings of at least one predetermined environmental condition. The sensor package 120 may be comprised of a smoke sensor, a gas sensor, a heat sensor or other sensor, such as a motion sensor. In addition, the sensor package may feature a combination of sensors that provides periodic reading of a plurality of environmental conditions.

Figure 2:
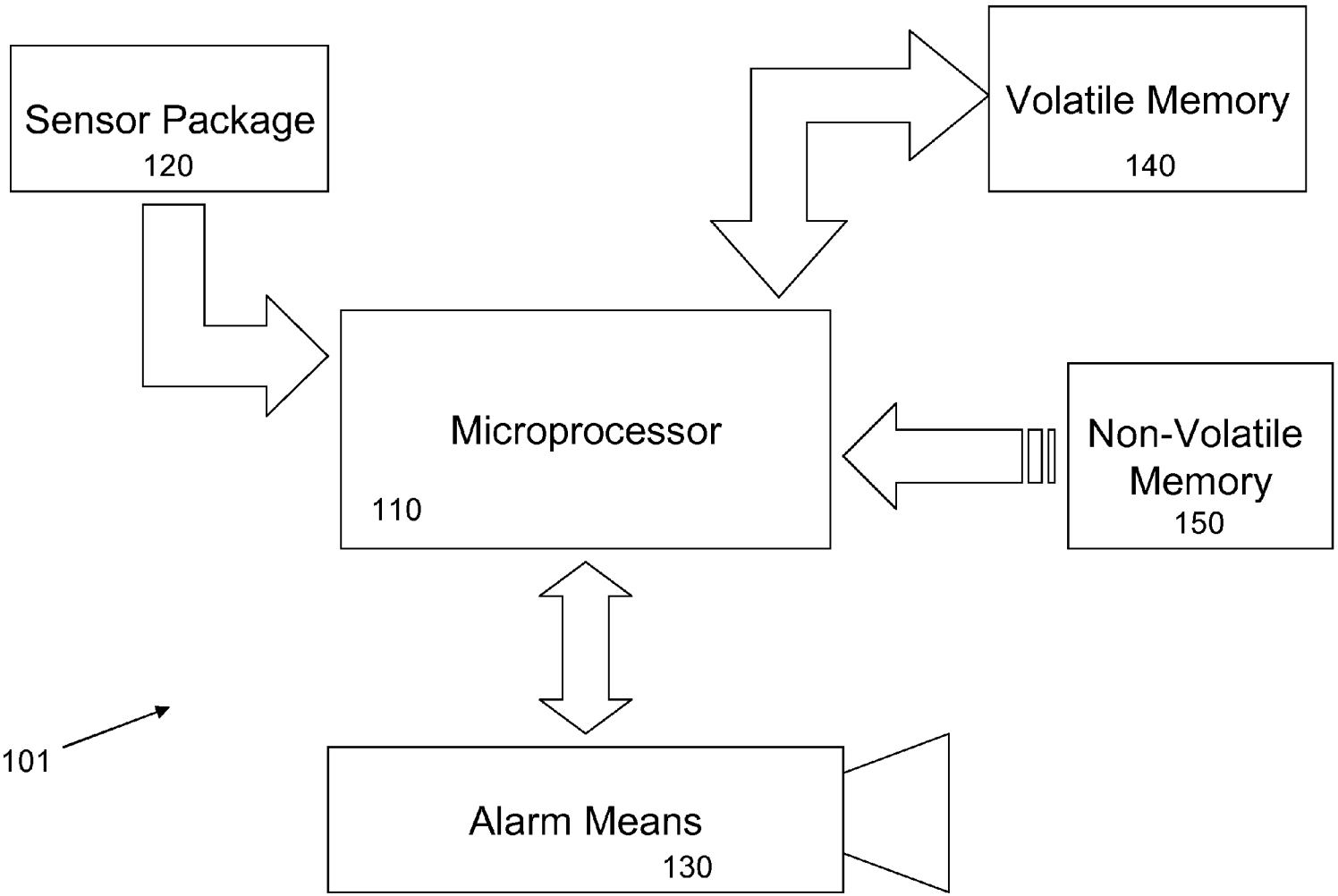
FIG. 2 is a block diagram of an embodiment of the system for hazardous condition detection wherein the sensor package is coupled directly to the microprocessor.

Sensor package 120 is coupled to at least one microprocessor 110 via an alarm means 130. The microprocessor 110 is of standard construction and commercially available from sources such as Microchip Technology, Inc. of Chandler, Ariz. as part number PIC16F526. Alarm means 130 is an ASIC optimized for hazardous condition detector use (smoke, gas, intrusion, etc.) and any supporting components including the visual, electronic, optical, magnetic and or audible signaling components. In other embodiments, the sensor package 120 may be coupled directly to the microprocessor 110 as illustrated in FIG. 2. Microprocessor 110 is coupled to or features volatile memory 140 and non-volatile memory 150. The volatile memory 140 and non volatile memory 150 may be resident on the microprocessor 110, or it may be embodied in a different or combination of chips.

Figure 3:
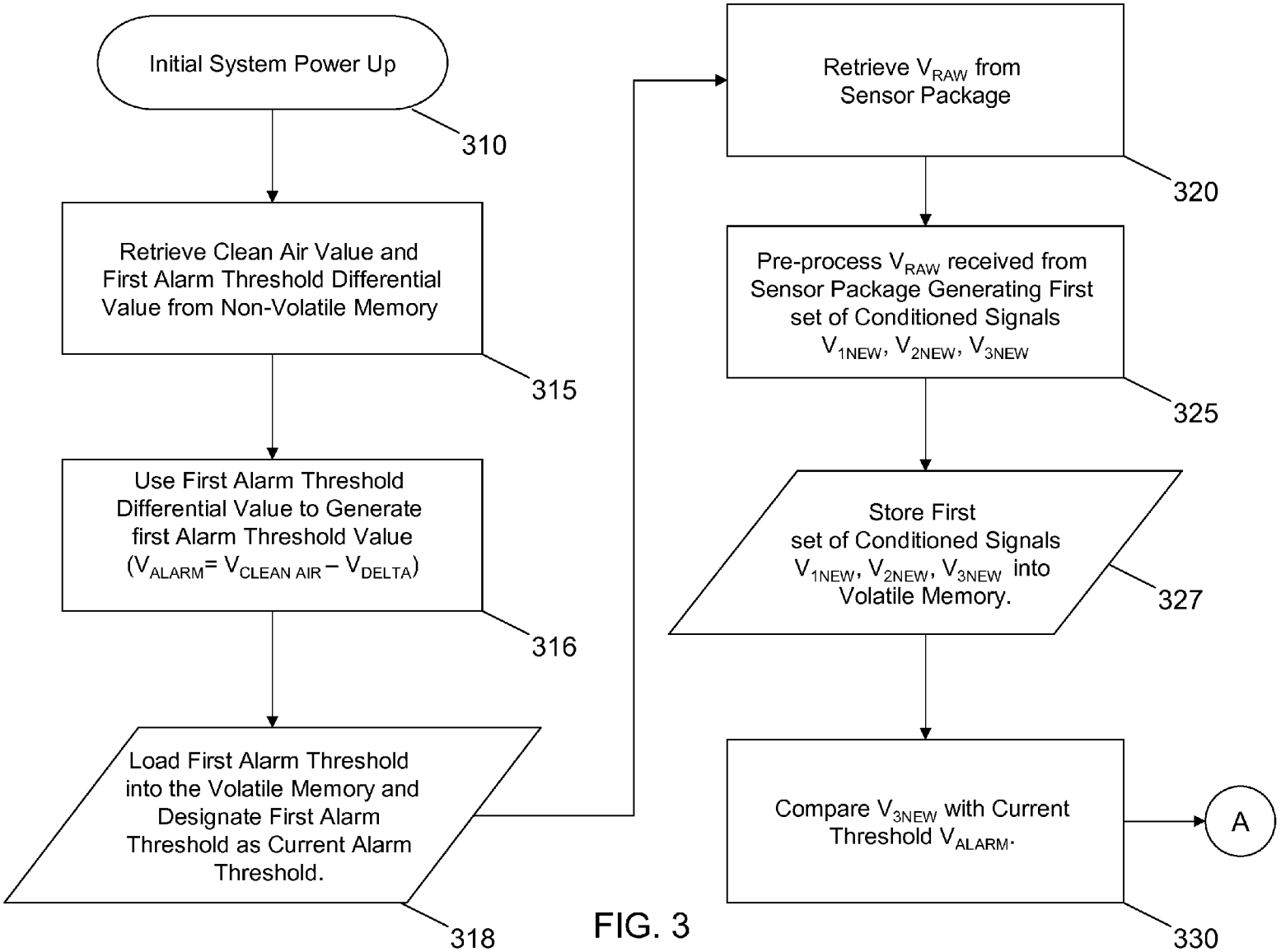
FIG. 3 is a flow diagram of an exemplarily embodiment of the system for providing ambient condition compensation in a hazardous condition detector for the initial detector start up.
Figure 6:
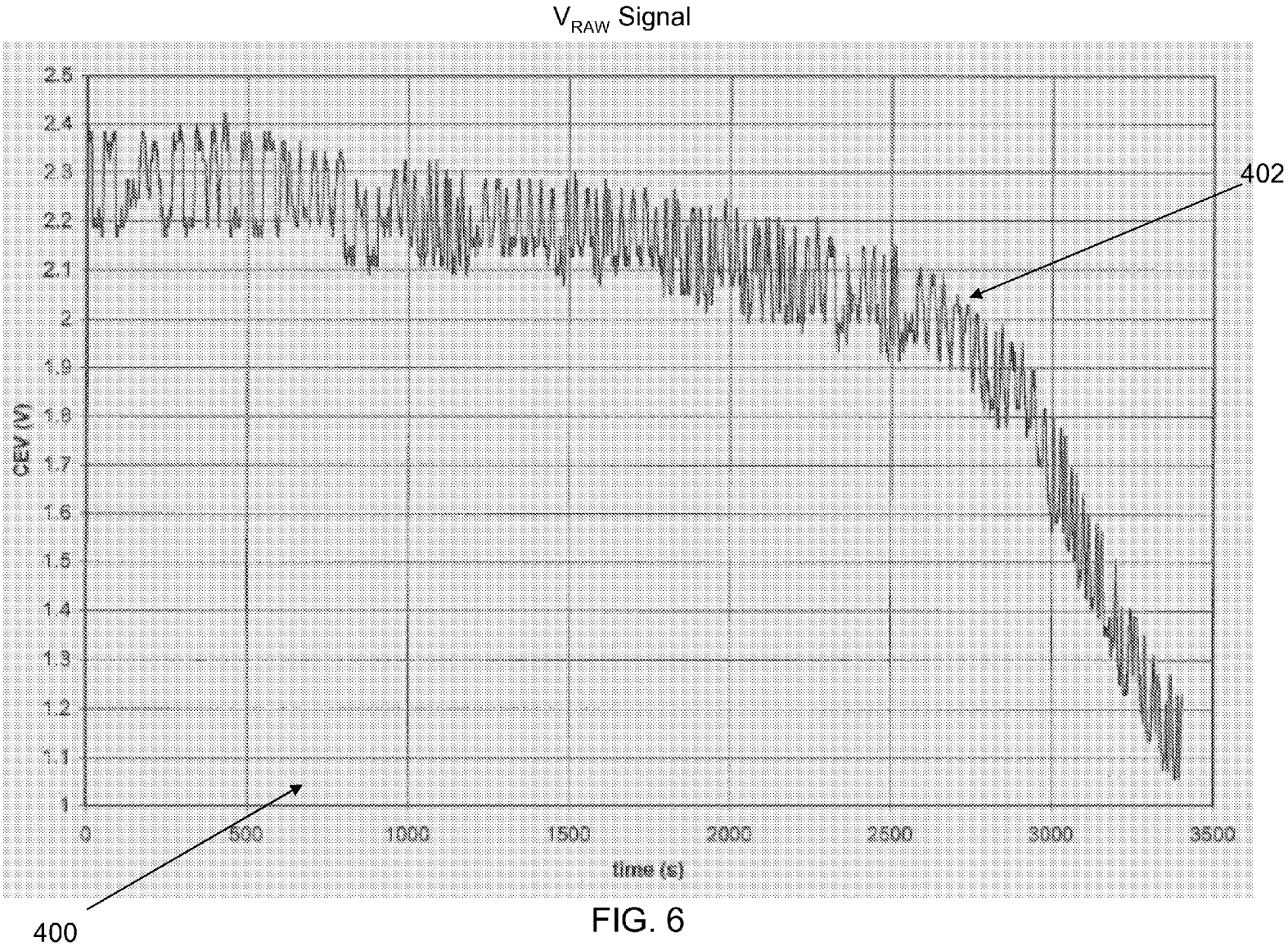
FIG. 6 is a graph of an exemplarily unconditioned output sample of an ionization sensor during a smoldering fire event ($cev_{raw}$).

FIG. 3 shows a flow diagram of an embodiment of a microprocessor controlled hazardous condition detection system employing the disclosed ambient condition compensation feature. Referring now to FIG. 3 with continued reference to FIG. 1, when the system 100 is initially powered up 310, the microprocessor 110 retrieves the clean air reading stored in non-volatile memory 150 and loads the clean air reading into the volatile memory 140. A first alarm threshold differential value is also retrieved 315 from the non-volatile memory 150 and is used to generate a first alarm threshold value 316. The alarm threshold differential value may or may not be stored in volatile memory. The first alarm threshold generated at system boot up when the volatile memory is empty is generated according to the relation:

$V_{ALARM}=V_{1NEW}-V_{DELTA}$, where $V_{1NEW}$ is the first conditioned signal and $V_{DELTA}$ is the initially selected alarm threshold differential value from the non-volatile memory. The first alarm threshold value, $V_{ALARM}$ is stored 318 in the volatile memory 140. The microprocessor 110 receives periodic raw readings of predetermined environmental, or ambient, conditions from the sensor package 120, 320 and stores the periodic readings of the environmental conditions in the volatile memory 140. FIG. 6 is a graph 400 of an exemplarily unconditioned output sample 402 ("raw signal") of an ionization sensor during a smoldering fire event ($V_{RAW}$).

With continued reference to FIG. 3, the microprocessor 110 preprocesses each of the raw environmental readings, $V_{RAW}$, by generating a set of at least three conditioned signals representative of the environmental reading 325. This first set of conditioned signals generated from the first raw sensor reading is stored in the volatile memory as $V_{1NEW}$, $V_{2NEW}$ and $V_{3NEW}$, respectively 327. With continued reference to FIGS. 1, 3, and 4, the microprocessor compares the conditioned $V_{3NEW}$ with the current alarm threshold stored in volatile memory 140, 330 to determine if an alarm condition is present. If the $V_{3NEW}$ is found to be in violation of the current alarm threshold 335, $V_{ALARM}$, the microprocessor causes the system to go into alarm mode 240.

The raw environmental signals are preprocessed 325 according to the relation:

$$V_{ot}=\frac{\sum_{t-n}^{t}[N*V_o+(V_{it}-V_{ot-1})]}{N}$$

where $V_o$ is the clean air reading or $V_{CLEAN\,AIR}$, $V_{ot}$ is the most recent computed output conditioned signal at time t or $V_{NEW}$, and $V_{it}$ is the new unconditioned raw input signal at time t or $V_{RAW}$. $V_{ot-1}$ is the previously computed output conditioned signal at time t-1 or $V_{PREV}$, where $V_{PREV}=V_{NEW(t-1)}$.

Each representative signal in the set of conditioned signals results from a different level of filtering applied to the raw environment signal. The level of signal filtration employed by the microprocessor is selected to generate a conditioned signal having a signal to noise ratio optimal for the particular comparison the microprocessor will use that particular conditioned signal for. The microprocessor varies the level of filtering by changing the filtering constant, N, employed when generating each conditioned signal of the set.

Figure 7:
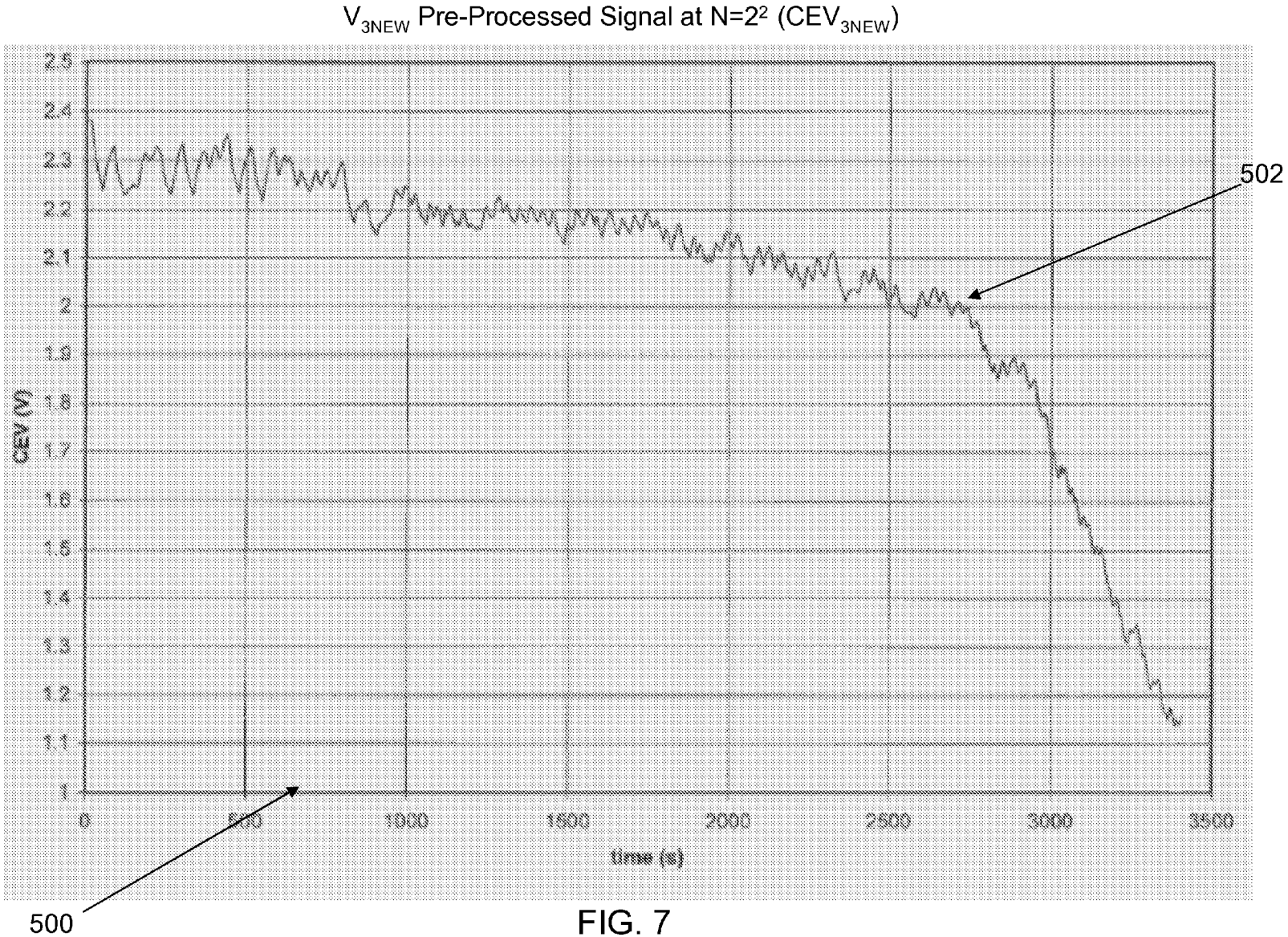
FIG. 7 is a graph of the exemplarily output sample of the ionization sensor of FIG. 4 pre-processed with a filtering constant of $2^2$ to generate $cev_{3new}$.
Figure 8:
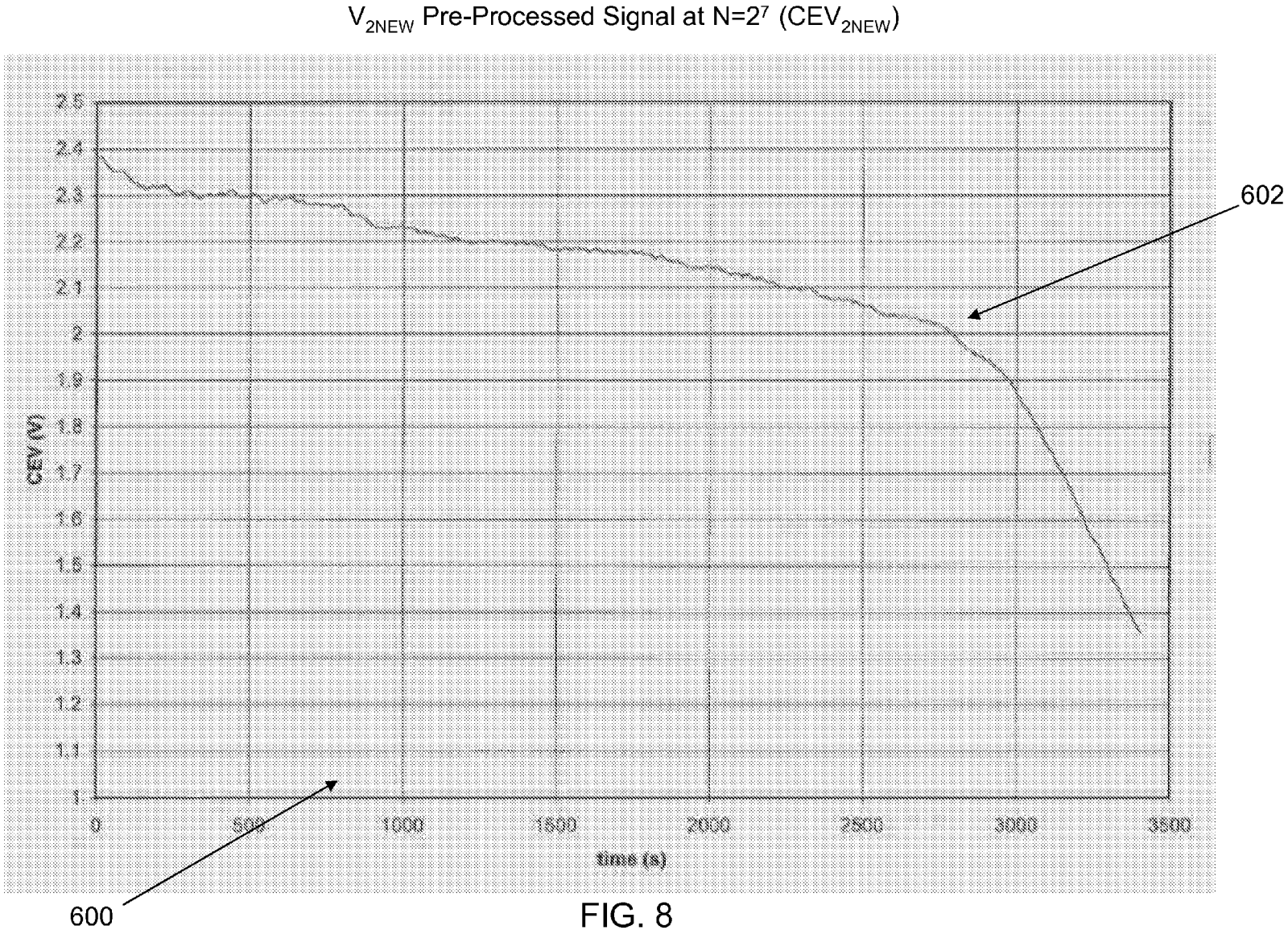
FIG. 8 is a graph of the exemplarily output sample of the ionization sensor of FIG. 4 pre-processed with a filtering constant of $2^7$ to generate $cev_{2new}$.
Figure 9:
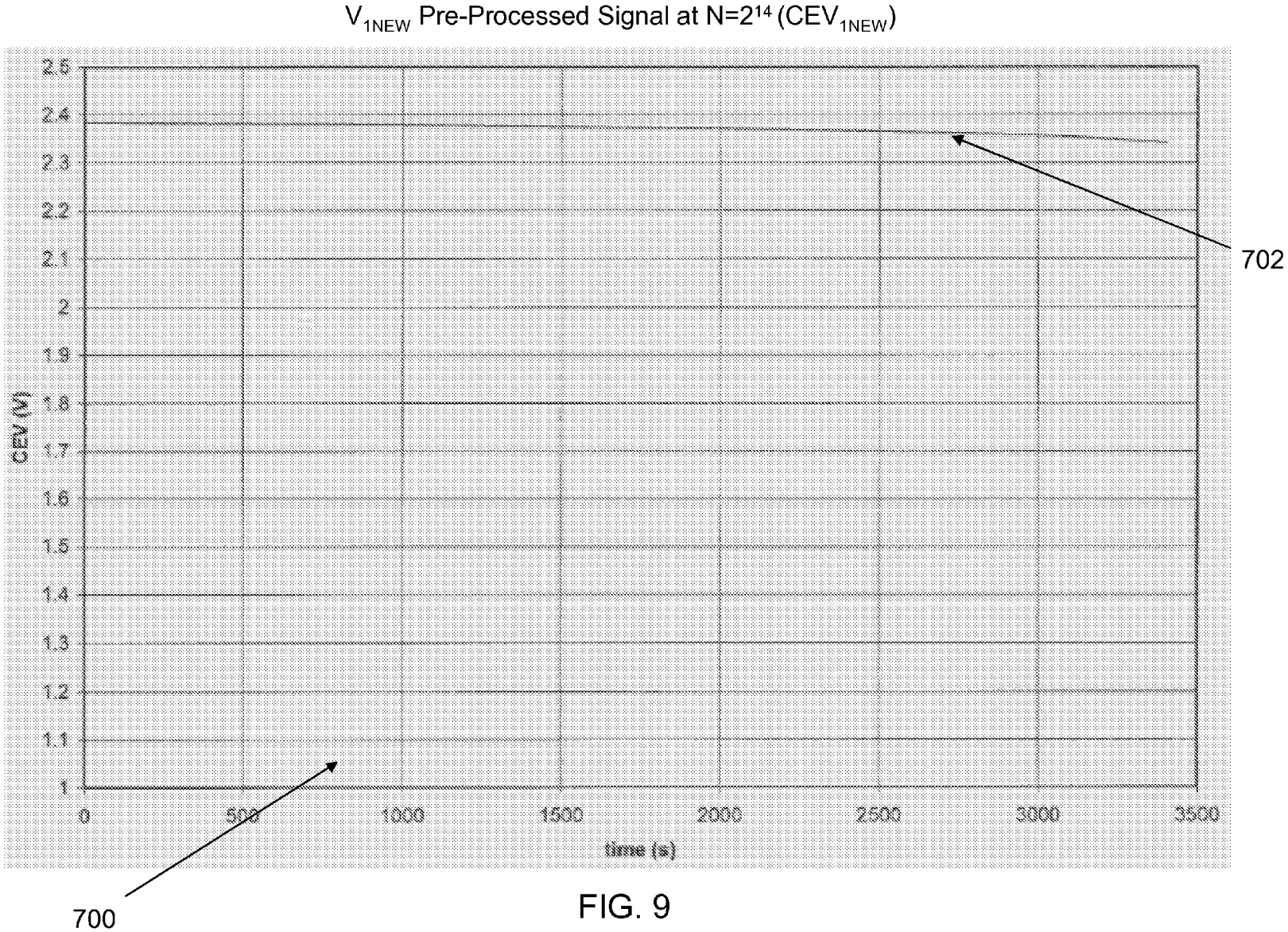
FIG. 9 is a graph of the exemplarily output sample of the ionization sensor of FIG. 4 pre-processed with a filtering constant of $2^{14}$ to generate $cev_{1new}$.

Typically the microprocessor will use 3 filtering constants. In the embodiment shown the selected filtering constants are $N_1=2^{14}$, $N_2=2^7$ and $N_3=2^2$. FIG. 7 is a graph 500 of the output signal 502 of the ionization sensor of FIG. 6 pre-processed with a filtering constant of $2^2$ ($V_{3NEW}$). FIG. 8 is a graph 600 of the output signal 602 of the ionization sensor of FIG. 6, pre-processed with a filtering constant of $2^7$ to generate $V_{2NEW}$ of the raw signal 402. FIG. 9 is a graph 700 of the output 702 ($V_{1NEW}$) of the ionization sensor of FIG. 6, preprocessed with a filtering constant of $2^{14}$ of the raw signal 402. In other embodiments of the preprocessing step the microprocessor 110 may generate more than three conditioned signals for the raw environmental signal received from the sensor package. As shown in FIGS. 6-8, the larger the filtering constant used, the greater the magnitude of signal filtering, and the slower the response of the filtered signal to changes in the sensor's output. In short, $V_{1NEW}$ represents changes in the conditions in the monitored space.

The microprocessor 110 stores the various sets of conditioned signals in the volatile memory 140. Each set of conditioned signals is formed from the plurality of conditioned signals generated from the single raw environmental signal at a point in time using the each of the filtering constants. The time a set of conditioned signals was generated, relative to other generated sets of conditioned signals is also recorded. Over time, the microprocessor 110 accumulates a plurality of sets of conditioned sensor readings in the volatile memory 140.

The microprocessor 110 selects and employs from the sets of conditioned signals, optimized subsets of the accumulated conditioned signals. Each optimized subset is selected from accumulated conditioned signals generated over time using the same filtering constant $N_X$. These subsets are is used by the microprocessor to make optimized signal processing comparisons of the sensor's output signal.

The use of optimized, comparison specific filtering reduces the volume of arithmetic operations required, ultimately reducing the processing load on the microprocessor by avoiding computationally demanding filtering operands where they are not required. The system 100, through the microprocessor 110 is able to perform several signal processing functions with a greatly reduced computational burden.

A benefit of the microprocessor employing optimized comparisons is the ability to change the system's sensitivity by selecting, from a plurality of available sensitivity levels, a particular sensitivity level associated with a detected signal profile, and generate and employ an appropriate alarm threshold. This feature is referred to as threshold selection. Optimization also allows the system to dynamically adjust or shift the selected alarm threshold value by a small amount to compensate over time for gradual changes in the environmental conditions in the monitored space such as heat, humidity, light, etc. This feature is referred to as ambient condition compensation.

Optimization of the comparisons also allows the system to employ a single ionization sensor that quickly responds to a smoldering fire event through the use of a signal having a high signal to noise level while maintaining the system's resistance to false alarms, in a computationally efficient manner. The optimization of the signal processing comparisons has the added effect of enhancing signal discrimination, thus minimizing false alarms.

By varying the alarm thresholds via a microprocessor, based on the ambient condition variations over time, smoldering fires are efficiently detected with ionization type detectors acting independently without the aid of other types of sensors. When employing an ionization type sensor the sensor package's output is characterized in terms of the central electrode voltage, or CEV.

In the case of an ionization type sensor, smoldering fire events typically yield a slow but persistent decrease in the CEV signal while fast flaming fire events produce rapid measured signal decrease. The disclosed systems allow the alarm sensitivity level to be increased when a profile suggesting the existence of a smoldering fire is detected to allow the product to alarm faster even with small levels of detected signal. A lower sensitivity level can be employed in the absence of a smoldering or other fire profile to bolster the system's resistance to false alarm.

The microprocessor processes the CEV signals by employing a ionization optimization algorithm, which selects between a plurality of CEV alarm threshold differential values, or $CEV_{DELTA}$ values selected to increase or decrease the sensitivity of the ionization sensor package based on the characteristics of the smoke or smoke event detected. With each selected $CEV_{DELTA}$ value, the microprocessor generates a distinct alarm threshold value or $CEV_{ALARM}$.

Signal Conditioning and Ionization Optimization

The microprocessor employs the ionization optimization algorithm to pre-process the raw signals retrieved from the ionization sensor package coupled to the ASIC, and generates a set of conditioned $CEV_{NEW}$ signals, $V_{1NEW}$, $V_{2NEW}$ and $V_{3NEW}$. The microprocessor accumulates sets of the $CEV_{NEW}$ signals and selects subsets from these accumulated sets to make the appropriate signal processing comparisons. The signal conditioning algorithm features ambient condition compensation, threshold selection and generation, and alarm event comparison aspects. Each is discussed in detail below.

The signal conditioning algorithm removes the noise and attenuation from the $V_{RAW}$ signal received from the ASIC employing low frequency digital filtering in a narrow band to generate the $V_{NEW}$. The noise and attenuation is removed from the signal by conditioning the unprocessed $V_{RAW}$ signal according to the relation:

$$V_{NEW(t)} = \frac{\sum_{t-n}^{t} [N * V_{CLEAN\,AIR} + (V_{RAW} - V_{PREV})]}{N}$$

where $V_{CLEAN\,AIR}$ is the clean air reading, $V_{NEW}$ is the most recent computed output conditioned signal at time t, and $V_{RAW}$ is the new unconditioned raw input data at time t, and $V_{PREV}$ is the previously computed output conditioned signal at time t-1, or $V_{PREV}=V_{NEW(t-1)}$.

Ambient Condition Compensation.

The system employs the $N_1$ value to determine the magnitude of the ambient condition compensation shift that the microprocessor employs. This ambient condition compensation is embodied in the conditioned $V_{1NEW}$ signal. The conditioned signal $V_1$ is generated from this first filtering constant. In the preferred embodiment the filtering constant $N_1$ used to generate $V_1$ is approximately $2^{14}$. Referring again to FIG. 9, the $V_{1NEW}$ value 702 is selected and used by the microprocessor for ambient condition compensation. The signal conditioning employed to generate the $V_{1NEW}$ value 702 is preferably optimized to respond to slow gradual changes in the signal over a matter of hours. The response to this type of filtered signal is relatively slow, and it would typically return less than optimal results if employed in signal comparisons directed to detect a traditional fast flaming fire.

In other embodiments the selected filtering constant $N_1$ used to generate $V_{1NEW}$ can be greater, which slows the response to environmental changes. In other embodiments a smaller filtering constant $N_1$ can be selected and employed which has the effect of increasing the system's response to changes in the ambient environment.

The conditioned signal $V_{1NEW}$ is employed to determine the ambient condition compensated value for the alarm threshold. In the preferred embodiment the conditioned signal $V_{1NEW}$ generated using the $2^{14}$ filtering constant incorporates the compensation shift. This compensated alarm threshold value is generated using the conditioned signal $V_1$ according to the following relation:

$V_{ALARM}=V_{1NEW}-V_{DELTA}$, where $V_{ALARM}$ is the compensated alarm threshold and $V_{DELTA}$ is the selected alarm threshold differential value.

This conditioned signal is generated during each iteration and only one previous value is used by the microprocessor 110 for the signal processing comparison. The system's optimization algorithm requires the storage of only the results of a single iteration of the generated conditioned $V_1$ signal in non-volatile memory to conserve memory resources. Over time the system may accumulate and retain a plurality of $V_{1NEW}$ signals generated from different raw signals as historical data or for other uses. At least one of the $V_{1NEW}$ signals is used to populate the first subset of conditioned signals.

Threshold Selection and Generation.

The microprocessor employs a second filtering constant to generate the conditioned signal $V_2$. In the preferred embodiment, a second filtering constant $N_2$, used to generate the conditioned signal $V_2$ is approximately $2^7$. In other embodiments the $N_2$ filtering constant employed may be larger or smaller. FIG. 8 is a graph of the output signal of the ionization sensor of FIG. 6, pre-processed with a filtering constant of $2^7$ 600 to generate $V_{2NEW}$ 602. The $V_{2NEW}$ value 602 is selected and used by the microprocessor to evaluate the rate of rise of the $V_{NEW}$ for purposes of selecting from the plurality of available threshold values.

The conditioned signal $V_2$ is employed by the system to determine whether or not generation of a new alarm threshold value, $V_{ALARM}$ is appropriate. The filtering constant $N_2$ is selected to provide response to changes in the sensor output sufficient to allow the microprocessor to quickly and efficiently identify changes in the periodic signals received from the sensor package. The microprocessor identifies any changing (increasing or decreasing) $V_{2NEW}$ trends in the accumulated conditioned $V_{2NEW}$ signals over a given period of time. That time period is preferably a matter of minutes, however shorter or longer periods are possible.

The characteristics of the identified trends are preferably associated with various signal profiles indicative of a particular fire event. Preferably each of these signal profiles has a unique alarm threshold differential value associated with it and upon identification of a $V_{2NEW}$ signal trend consistent with a particular signal profile the microprocessor selects the alarm threshold differential value $V_{DELTA}$ associated with the particular signal profile. The system's microprocessor uses the selected $V_{DELTA}$ to generate an appropriate alarm threshold value, $V_{ALARM}$ optimized for early detection of the associated fire event. Typically the $V_{DELTA}$ associated with a smoldering fire event is approximately 200 mV and the $V_{DELTA}$ associated with traditional fires is approximately 900 mV. Other $V_{DELTA}$ values may be associated with other types of fire events or intermediate signal profiles providing ever increasing $V_{ALARM}$ threshold optimization.

The microprocessor generates the $V_{2NEW}$ conditioned signal during each periodic iteration of receiving the raw signal from the sensor package and generating the set of $V_{1NEW}$, $V_{2NEW}$ and $V_{3NEW}$ conditioned signals. A small subset of the $V_{2NEW}$ values generated over time is used by the microprocessor to determine the existence of a particular signal trend for the comparison. To conserve memory resources, the system's optimization algorithm employs requires the system to store only the results of a small plurality of iterations of the generated conditioned $V_{2NEW}$ signal in non-volatile memory depending on the number of increasing or decreasing values deemed necessary to define a signal trend associated with a particular signal profile. In the preferred embodiment the system stores less than 10 conditioned $V_{2NEW}$ signal values. The system may retain a larger plurality of conditioned $V_{2NEW}$ signal values generated from different raw signals as historical data or for other uses.

Alarm Event Detection.

The microprocessor employs a third filtering constant to generate the conditioned signal $V_{3NEW}$. In the preferred embodiment a second filtering constant $N_3$, used to generate the conditioned signal $V_{3NEW}$ is approximately $2^2$. In other embodiments the $N_3$ filtering constant employed may be larger or smaller.

The $V_{3NEW}$ value 502 (See FIG. 7) is selected and used by the microprocessor for the V comparison step to determine if an alarm condition is present. Employing the smaller $2^2$ constant generates a $V_{NEW}$ signal with a faster response time, making it more sensitive to abrupt changes in the conditions monitored by the ionizations sensor package. This characteristic makes the $V_{3NEW}$ value 502 most appropriate for the comparisons with the selected alarm threshold to determine the existence of a fire event. The $N_3$ filtering constant is selected to provide a relatively quick response to a fire event. A large filtering constant and the resulting highly filtered signal, is significantly less response and not required for the alarm event detections since the $N_1$ and $N_2$ filtering constants used in generating the $V_{1NEW}$ and $V_{2NEW}$ conditioned signals during the ambient condition compensation, and the threshold selection processing provides a significant portion of the signal filtering.

As illustrated in FIG. 3, the microprocessor compares the generated $V_{ALARM}$ to the $V_{3NEW}$ conditioned signal and if the $V_{3NEW}$ is determined to be in violation of the $V_{ALARM}$ and alarm event is initiated. Since the microprocessor performs a significant amount of the signal filtering in the earlier phases of the process, a $V_{3NEW}$ signal optimized to provide a quick response to a potentially hazardous condition is used. This provides the system with enhanced sensitivity to smoldering fire events, while simultaneously maintaining resistance to false alarms.

This $V_{3NEW}$ conditioned signal is generated during each iteration and only one of the previous values is used to for the comparison. To conserve memory resources, the system's optimization algorithm requires the system to store only the results of a single iteration of the generated conditioned $V_{3NEW}$ signal in non-volatile memory. The system may retain several $V_{3NEW}$ signals generated from different raw signals as historical data or for other uses.

Figure 4:
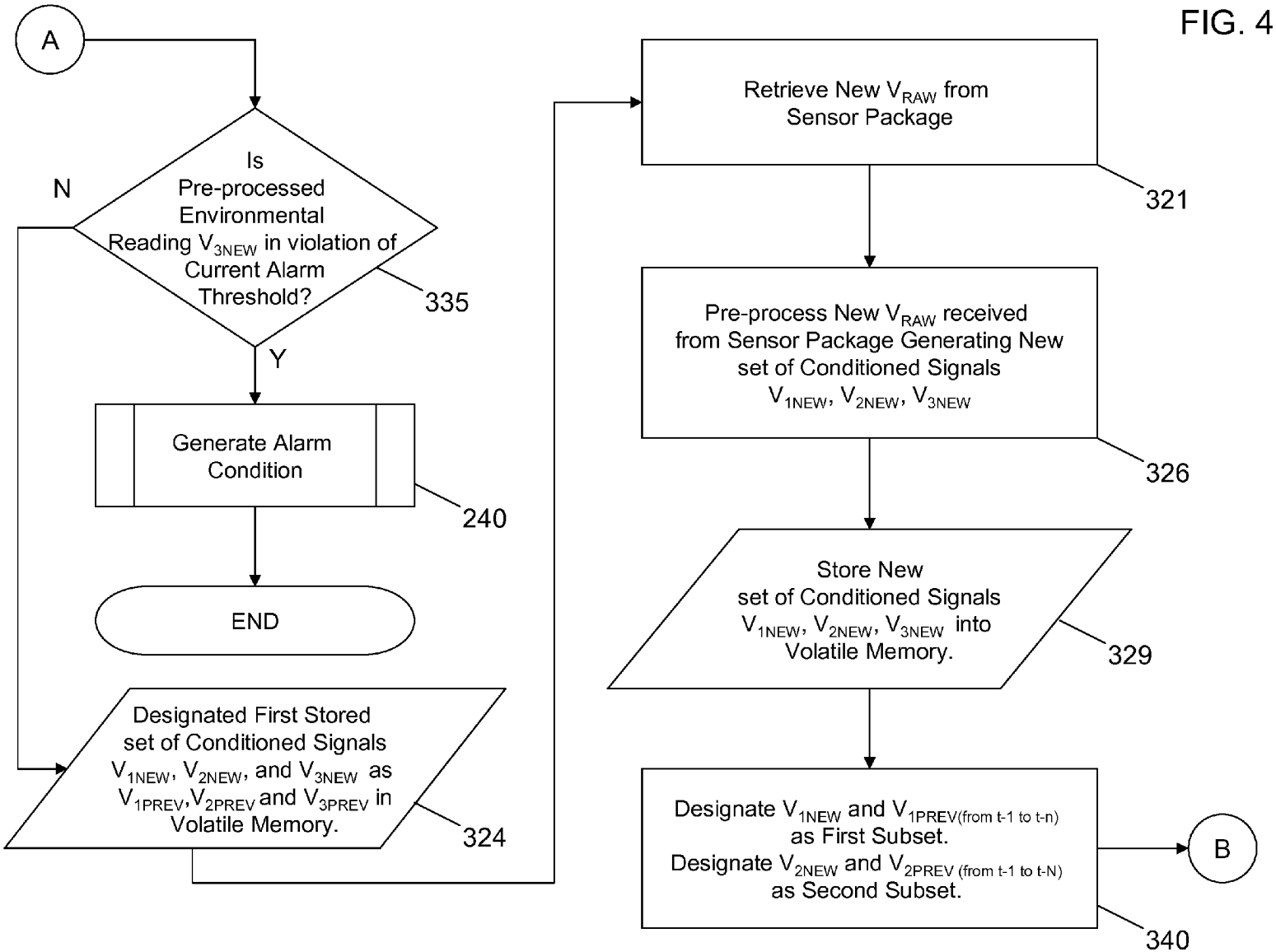
FIG. 4 is a continuation of the flow diagram of the exemplarily embodiment of the system for providing ambient condition compensation in a hazardous condition detector from FIG. 3.

Referring again to the embodiment shown in FIG. 4 with continued reference to FIGS. 1 and 3, once the initial alarm threshold is generated 316 and the microprocessor determines that the initial $V_{3NEW}$ conditioned signal is not in violation of the current alarm threshold 335, the microprocessor designates the first stored set of conditioned signals $V_{1NEW}$, $V_{2NEW}$, $V_{3NEW}$ as $V_{1PREV}$, $V_{2PREV}$ and $V_{3PREV}$ in the volatile memory 140. The microprocessor 110 retrieves a new $V_{RAW}$ signal 321 from the sensor package 120 and pre-processes the new $V_{RAW}$ signal generating a new set of conditioned signals $V_{1NEW}$, $V_{2NEW}$, and $V_{3NEW}$, 326. The new set of conditioned signals is stored in the volatile memory 140, 329. The microprocessor then designates a first and second subset of conditioned signals 340. The first subset of conditioned signals must include at least the current (most recent) $V_{1NEW}$ conditioned signal. In other embodiments, the subset may include a plurality of $V_{1PREV}$ conditioned signals going back in time from t-1 to t-n. This first subset ($V_{1NEW}$) is used for purposes of the compensation shift, and in the preferred embodiment incorporates the compensated alarm threshold value.

The second subset of designated conditioned signals must include at least the current (most recent) $V_{2NEW}$ conditioned signal and at least one accumulated $V_{2PREV}$ conditioned signals going back in time from t-1 to t-n. Typically the second subset contains the minimum the number of $V_{2PREV}$ conditioned signals specified by the microprocessor 110 as sufficient to define a trend of decreasing $V_{2NEW}$ signals. In a preferred embodiment the $V_{2PREV}$ is limited to 7 $V_{2PREV}$ signals. In other embodiments, the subset may include substantially more or less.

Figure 5:
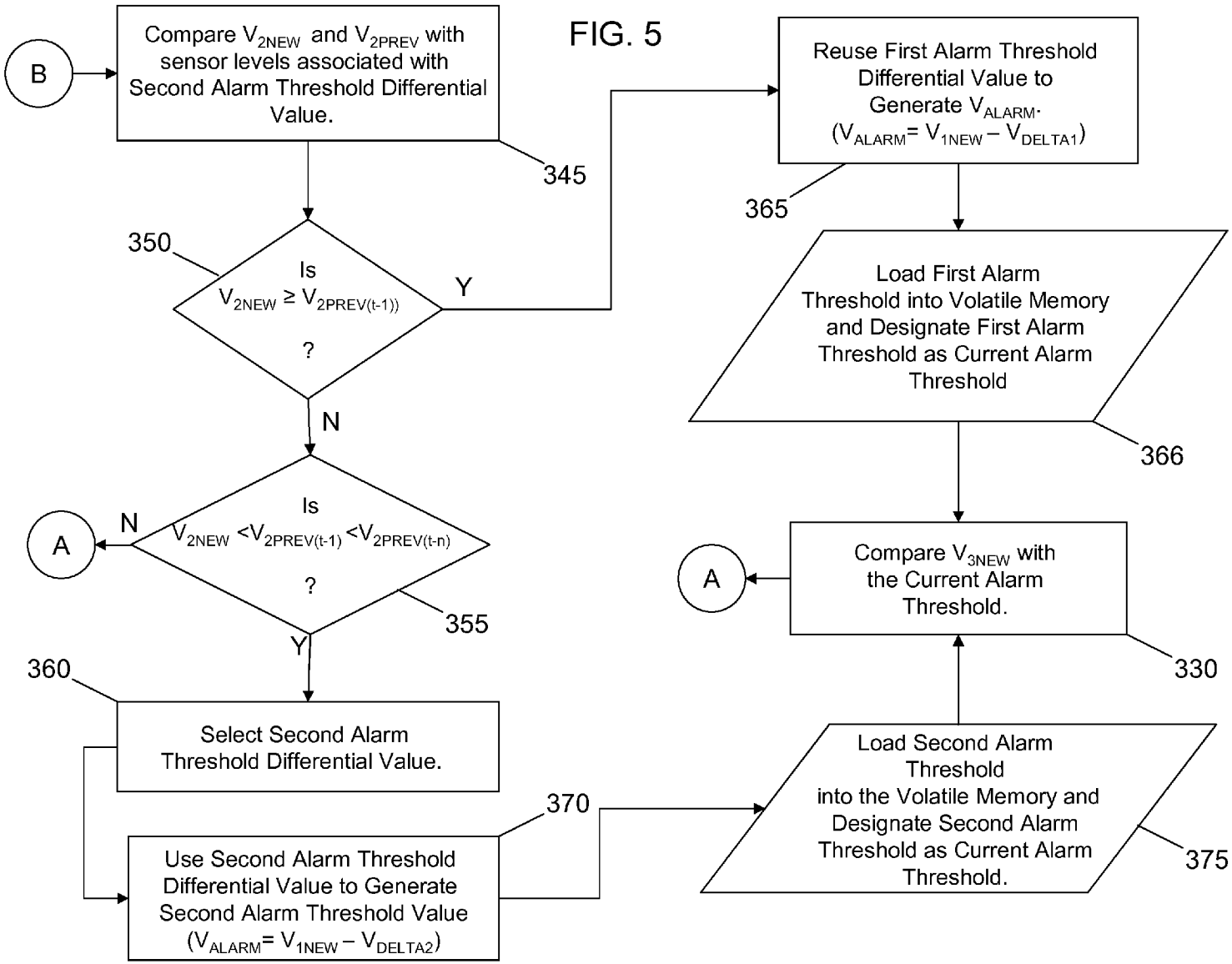
FIG. 5 is a continuation of the flow diagram of the exemplarily embodiment of the system for providing ambient condition compensation in a hazardous condition detector from FIG. 4.

Referring now to FIG. 5, the system 100 enters into the threshold selection and generation mode, in which the microprocessor 110 compares the $V_{2NEW}$ signals to determine the presence of a continuous trend in the conditioned $V_{2NEW}$ signals. The microprocessor 110 searches for a continuous change in trend of the conditioned $V_{2NEW}$ signals by comparing the $V_{2NEW}$ and $V_{2PREV(t-1)}$ signals 350.

If the amount of change from $V_{2NEW}$ and $V_{2PREV(t-1)}$ is substantial the microprocessor evaluates the $V_{2PREV}$ signal contained in the second subset or conditioned signal to determine the length or extent of the trend of changing conditioned $V_{2NEW}$ signals 355. If $V_{2NEW} \Delta V_{2PREV(t-1)} \Delta \ldots V_{2PREV(t-n)}$, where n=2, a sensitivity change is determined to not be appropriate and a new threshold is not generated.

When $V_{2NEW} \Delta V_{2PREV(t-1)} \Delta \ldots V_{2PREV(t-n)}$ where n is the number of continuous decreasing signals necessary to indicate an event trend, exceeds a pre-set threshold fixed in the non-volatile memory, then the microprocessor determines that a sensitivity shift is appropriate and selects a second alarm threshold differential value $V_{DELTA2}$ 360 from the non-volatile memory and generates an new alarm threshold value, $V_{ALARM}$ therewith 370. The system's microprocessor loads the second alarm threshold value into volatile memory and designates the $V_{ALARM}$ as the current alarm threshold 375.

The microprocessor then compares the $V_{3NEW}$ conditioned signal with the current alarm threshold, $V_{ALARM}$ 330, and generates an alarm 240 if the $V_{3NEW}$ conditioned signal is in violation of the current alarm threshold 335. If the $V_{3NEW}$ conditioned signal is determined by the microprocessor 110 not to violate of the current alarm threshold 335, the microprocessor designates the stored set of conditioned signals 324 ($V_{1NEW}$, $V_{2NEW}$, $V_{3NEW}$) as $V_{1PREV}$, $V_{2PREV}$ and $V_{3PREV}$ in the volatile memory 140, and retrieves a new $V_{RAW}$ signal 321 from the sensor package 120, and pre-processes the new $V_{RAW}$ signal 326. The number of changing $V_{2NEW}$ readings necessary to indicate an event trend may vary. If this condition is met, for example, the delta of the $V_{2NEW}$ signals are continuous, but the duration of the trend is not to a level that identifies a different fire profile, the microprocessor performs the alarm event comparison by determining whether the $V_{3NEW}$ is in violation of the current alarm threshold $V_{ALARM}$ 335.

If the $V_{2NEW}$ varies significantly from $V_{2PREV(t-1)}$ 350, the microprocessor 110 reuses the first alarm threshold differential value $V_{DELTA1}$ to generate the alarm threshold $V_{ALARM}$ 365. The microprocessor loads the first alarm threshold value into volatile memory and designates the $V_{ALARM}$ as the current alarm threshold 366. The microprocessor 110 compares the $V_{3NEW}$ conditioned signal with the current alarm threshold, $V_{ALARM}$ 330, and generates an alarm if the $V_{3NEW}$ conditioned signal is in violation of the current alarm threshold 240. If the $V_{3NEW}$ conditioned signal is determined by the microprocessor 110 not to violate of the current alarm threshold 335 the microprocessor 110 designates 324 the stored set of conditioned signals $V_{1NEW}$, $V_{2NEW}$, $V_{3NEW}$ as $V_{1PREV}$, $V_{2PREV}$ and $V_{3PREV}$ in the volatile memory 140, and retrieves a new $V_{RAW}$ signal 321 from the sensor package 120 and pre-processes the new $V_{RAW}$ signal.

In other embodiments, the system may associate a third alarm threshold differential value with a third predetermined set of ionization levels and compare the subset of the $V_{2NEW}$ and $V_{2NEW(t-n)}$ conditioned sensor readings with the third predetermined set of ionization levels associated with the third alarm threshold differential value. If the conditioned sensor readings in the second subset of the $V_{2NEW}$ and $V_{2NEW(t-n)}$ conditioned sensor readings are within the ionization levels specified in the third predetermined set of ionization levels associated with the third alarm threshold the microprocessor 110 selects the third alarm threshold differential value or $V_{DELTA3}$, generates a third alarm threshold value from the selected third alarm threshold differential value, and designates the third alarm threshold value as the current alarm threshold. The number of alarm threshold differential values stored in non-volatile memory is not limited.

This process of adjusting or varying the alarm threshold value within a given allowable range, and/or selecting a new threshold optimized for the profile of the smoke detected enables the system 100 to dynamically adjust the sensitivity of the detector depending on the changes in the environmental conditions in the monitored space. To compensate for changes in the type of smoke detected the microprocessor can adjust the sensitivity by selecting a new $V_{DELTA}$, generating and ultimately employing a new alarm threshold optimized for the detected fire profile. The microprocessor is further able to adjust a selected alarm threshold value by a small amount over time to compensate for changes in the ambient environment such as heat, humidity, light, etc. When the system detects an ambient environmental condition outside of the alarm threshold stored in the volatile memory 140, the microprocessor 110 designates an alarm event and causes the alarm means 130 to generate an alarm.

Figure 10:
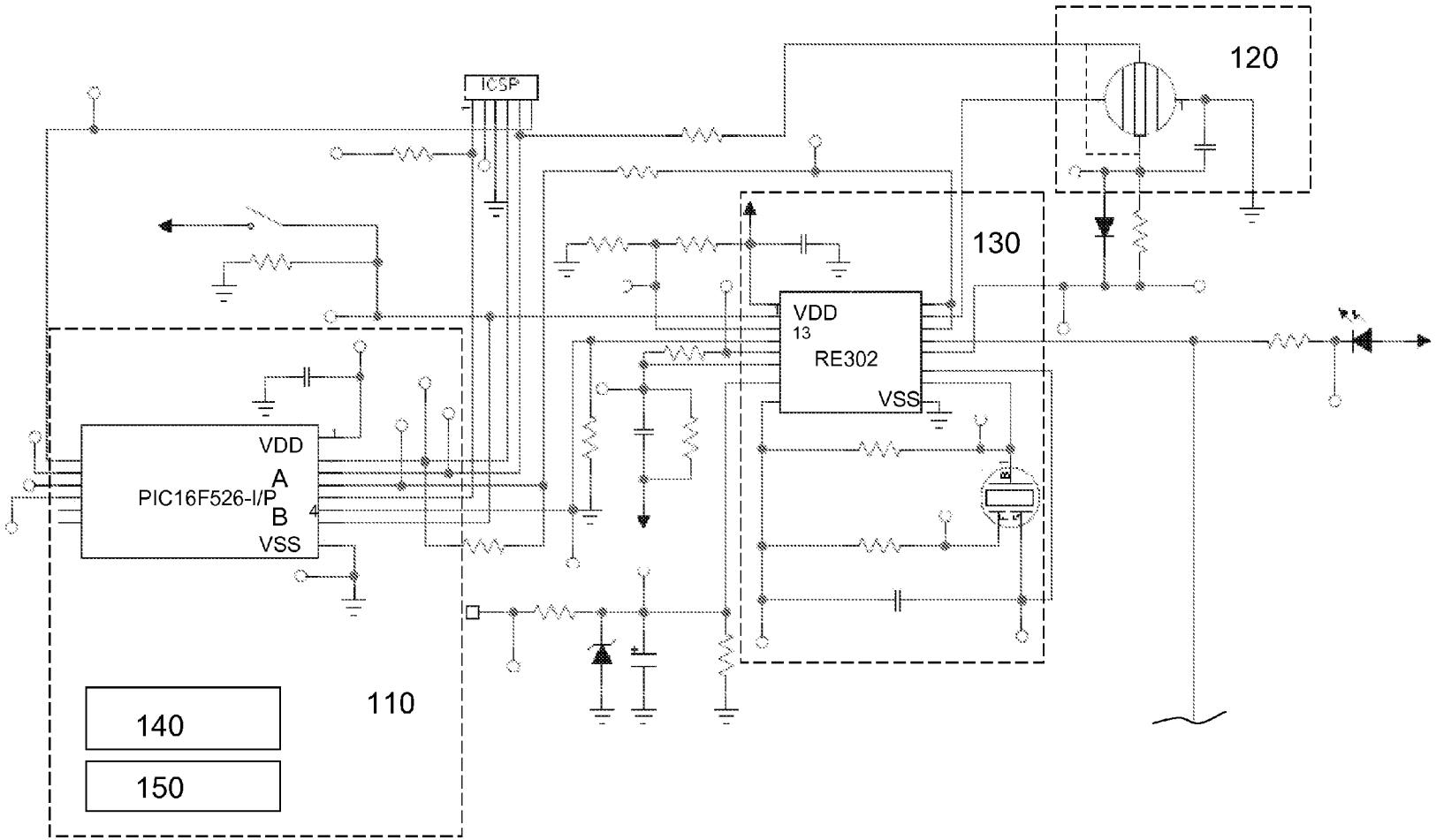
FIG. 10 is an exemplary schematic illustrating circuitry to achieve the invention using a smoke detector ASIC coupled directly to the sensor package.

FIG. 10 shows an exemplary schematic diagram of circuitry employed to achieve the wake up feature of the instant invention using a smoke detector ASIC coupled to a single ionization sensor. The ASIC is of conventional structure and is available from Microchip Technology, Inc. (Chandler, Ariz.), Part No. RE302, Allegro Microsystems, Inc. (Worcester, Mass.) Part No. A5364 and Freescale Semiconductor, Inc. (Austin, Tex.) Part No. MC145012. The sensitivity set is typically used to adjust the sensitivity of the smoke detector by attaching resistors thereto. In the exemplary embodiment, the sensitivity set is pin 13. Pin 13 of the ASIC is attached to pin 3 of the microprocessor as seen in FIG. 10 point 'B'. Typically this pin is only active for 10 mS every 1.67 second period. When this pin is not active, it is placed on a high impedance state. When the pin is inactive the microprocessor goes into what can be described as a "halt" or "active halt" mode, minimizing the system's power consumption. When the pin is active, the microprocessor interrupt is extinguished and the microprocessor wakes. Since the microprocessor is not always active and consuming the system's power, extended operational life when dependent on battery power is realized compared to conventional configurations.

When pin 13 is active, the impedance is low allowing current flow to the microprocessor coupled to the pin. The current flow in pin 13 wakes the microprocessor and the microprocessor is active during the 10 mS period. During this 10 mS period the microprocessor retrieves/receives the sensor package measurements, evaluates the results, and determines if an alarm event exist. If an alarm event is determined to exist, the microprocessor forces pin 13 to go to a high voltage overriding the deactivation signal forcing the ASIC into an alarm mode. If no alarm event is detected by the microprocessor during the active period, the microprocessor does not override pin 13 and will return to sleep mode until the ASIC's next 10 mS active period.

Since the microprocessor spends a significant amount of time, corresponding to the ASIC's inactive period, in sleep mode a substantial power savings is realized. This conservation of battery power significantly extends the system's battery life.

Also, the embodiment shown uses the microprocessor output pin to power the single ionization detectors ion chamber as shown in FIG. 10 at point 'A'. The output pin of the microprocessor typically produces a stable 5V output, and provides stable CEV readings from the ion chamber. The stable microprocessor output prevents the CEV reading from declining as the battery drains which can cause false alarm due to entry into the enhanced sensitivity mode, or applying a smoldering threshold due to decreasing battery charge.

Figure 11:
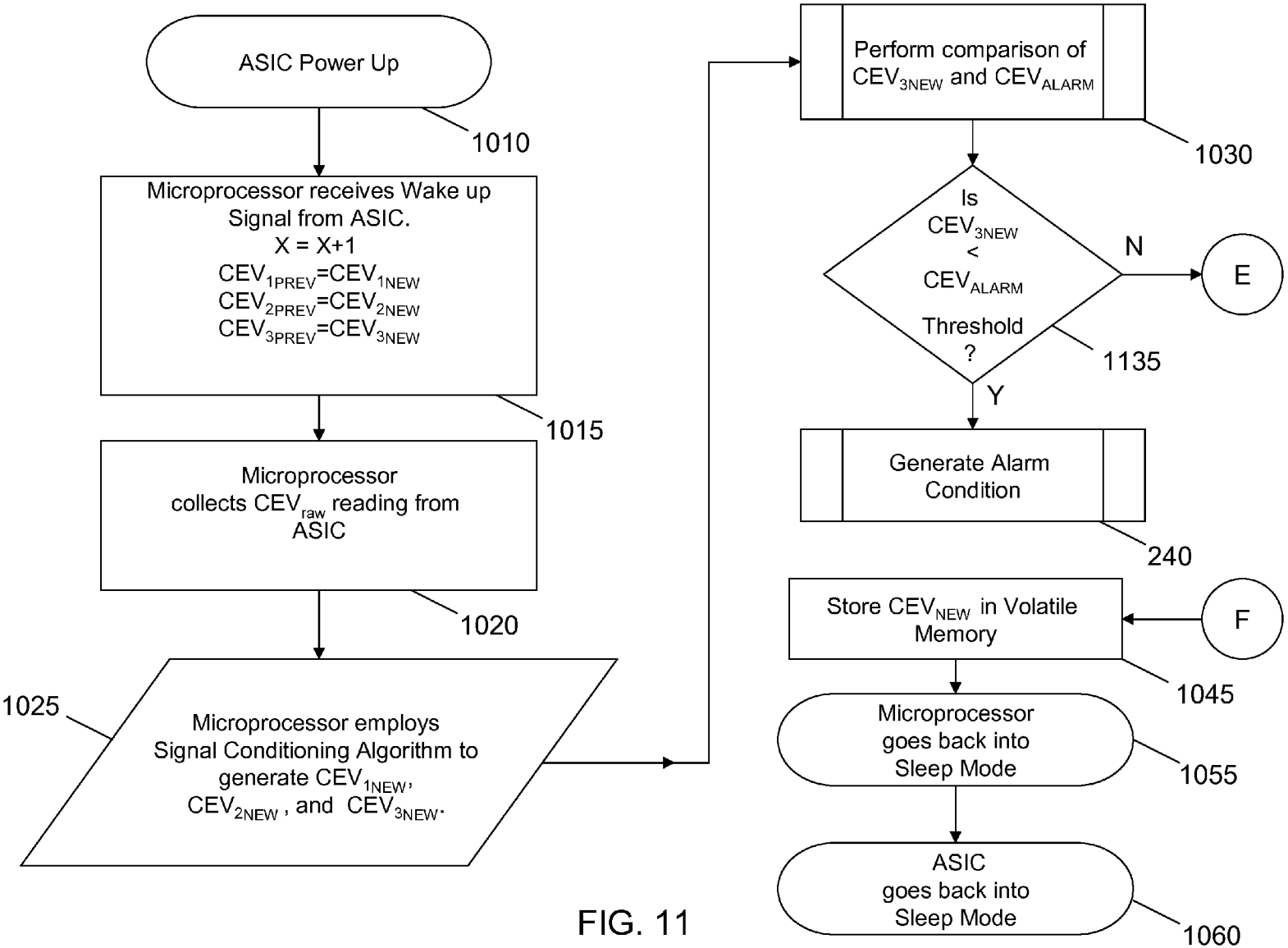
FIG. 11 is a flow diagram for an embodiment of an ionization type hazardous condition detector employing the wake up feature and an ionization optimization algorithm employing distinct alarm thresholds for two different types of fire events.
Figure 12:
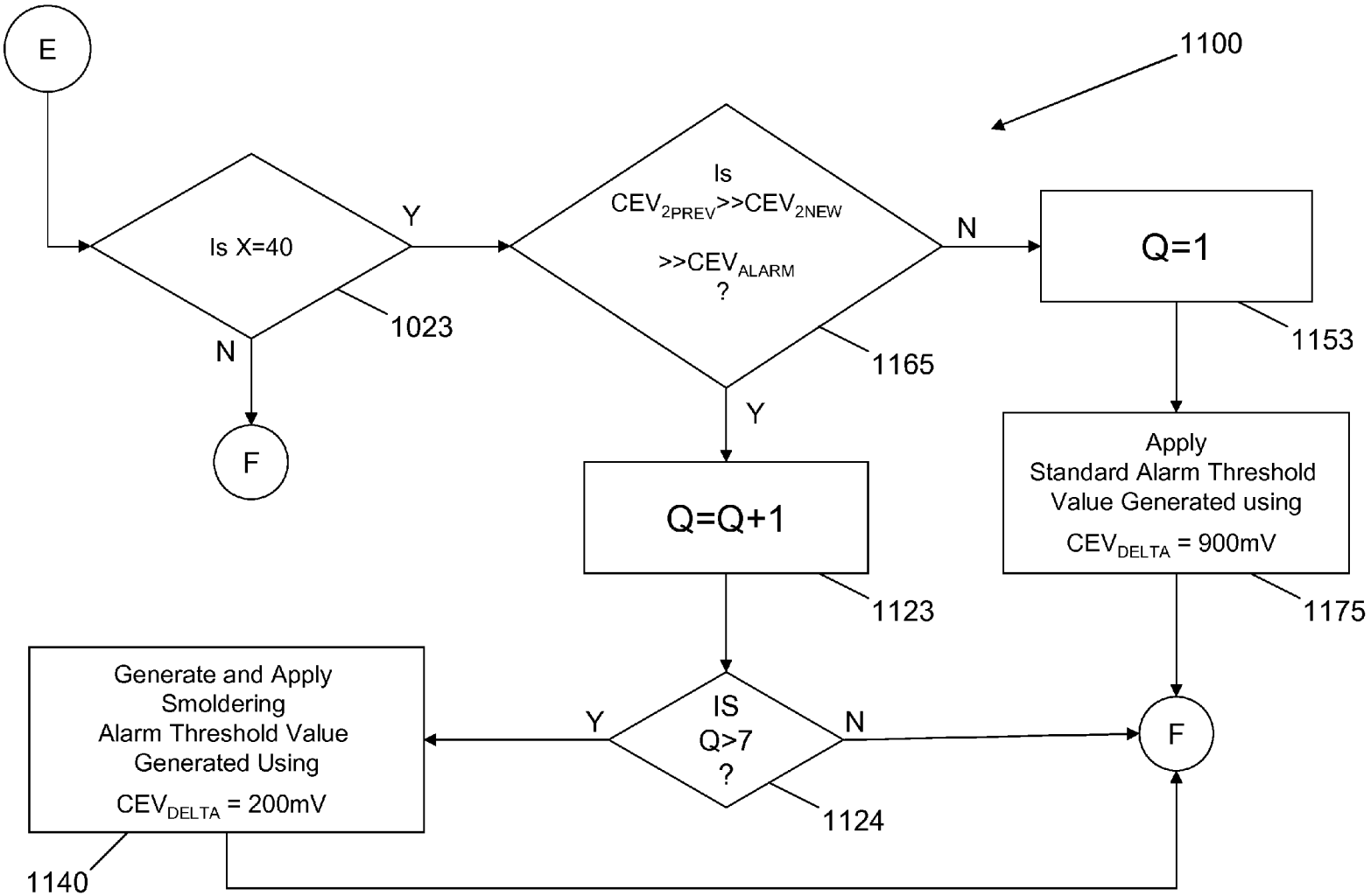
FIG. 12 is a flow diagram for an embodiment of an ionization type hazardous condition detector employing the wake up feature continued from FIG. 11 showing an ionization optimization algorithm employing two distinct alarm thresholds for two different types of fire events

FIG. 11 and FIG. 12 show flow diagrams for an exemplary ionization type hazardous condition detector employing the wake up feature and the ionization optimization algorithm. The ASIC 130 preferably controls the sensing/detection/alarm functions as well as the power management functions. The signal processing functions, including the variable threshold functions, are preferably controlled by the microprocessor 110. The ASIC 130 typically functions as a slave unit feeding the microprocessor signal and receiving subsequent alarm instructions from the microprocessor 110. The ASIC's power management feature powers up/down the ASIC 130 at a predetermined interval and is used to power up and power down the microprocessor 110.

Referring now to FIG. 11, with continued reference to FIG. 1 in the illustrated embodiment, the ASIC 130 powers up every 1.67 seconds and takes an ionization reading through the ionization sensor 1010. This reading is the $CEV_{RAW}$ reading and represents an unprocessed signal. On power up, the ASIC 130 sends a wake up signal to the microprocessor 1015. In response to the ASIC's wake up signal, the microprocessor 110 becomes active for a period of 10 milliseconds. In this 10 millisecond active period, the microprocessor 110 performs signal processing tasks and determines whether or not an alarm condition is present, or whether or not an alarm threshold shift is appropriate. In other embodiments, a smaller or larger temporal window may be employed to perform the signal processing tasks.

Upon wake up, the microprocessor 110 increments an iteration counter and sets $CEV_{PREV}=CEV_{NEW}$, as a power up initiation step 1015 prior to calculating the current $CEV_{NEW}$. In setting the $CEV_{PREV}$ to $CEV_{NEW}$ the microprocessor saves the previous set of conditioned $CEV_{NEW}$ signals into volatile memory 140. Next, the microprocessor 110 collects a $CEV_{RAW}$ reading 1020 from the ASIC 130 and employs a signal conditioning algorithm 1025 to the $CEV_{RAW}$ signal. This pre-processing step generates a set of $CEV_{NEW}$ values.

The set of $CEV_{NEW}$ values includes at least a $CEV_1$, $CEV_2$, and $CEV_3$ generated by employing varying levels of filtering, optimized for different comparison tasks, when the signal is conditioned. As discussed above the $CEV_1$ value is optimized for determining the small shifts in the thresholding that vary with the ambient condition such as temperature and humidity and is not discussed in detail in this exemplarily embodiment. The $CEV_2$ is optimized and selected for use in comparisons to determine whether or not a new smoldering threshold or a traditional fire event threshold is appropriate. The $CEV_3$ is optimized and selected for comparisons used to quickly evaluate whether or not a fire event exist.

Once the microprocessor 110 generates the set of $CEV_{NEW}$ values, which are the conditioned signal, the microprocessor 110 periodically compares selected $CEV_{NEW}$ signals from the set with the current $CEV_{ALARM}$ value. The microprocessor 110 typically stores the set of $CEV_{NEW}$ signals generated at the power up initiation step 1015 at periodic intervals but may store the set of $CEV_{NEW}$ signals at each wake up cycle.

The microprocessor 110 performs the comparison step 1030 when it compares the $CEV_{3NEW}$ and the $CEV_{ALARM}$ value by employing an ionization optimization algorithm 1100. The microprocessor 110 compares the $CEV_{3NEW}$ with the $CEV_{ALARM}$ at each wake up cycle or it may periodically compare the $CEV_{3NEW}$ and the $CEV_{ALARM}$. In the embodiment shown in FIG. 11, the CEV comparison is performed every 40 sleep/wake cycles 1023 or approximately every 70 seconds. Preferably, the microprocessor 110 periodically adjusts the currently selected $CEV_{ALARM}$ to compensate for minute changes in the ambient conditions. In one form of the invention, the selected $CEV_{ALARM}$ may be adjusted by ±50 mV at intervals of 5 sleep/wake cycles to compensate for temperature and humidity changes in the monitored space, while the CEV comparison for alarm determination and/or ionization optimization is performed every 40 sleep/wake cycles. In other embodiments the interval and magnitude of the $CEV_{ALARM}$ adjustment for ambient condition compensation may vary. In the preferred embodiment the $CEV_{ALARM}$ compensation adjustment is performed at every microprocessor power up iteration in which a $CEV_{1NEW}$ signal is generated.

Referring now to FIG. 12, if the microprocessor 110 determines that the $CEV_{3NEW}<CEV_{ALARM}$ threshold 1135, an alarm condition is inferred to be present and the microprocessor 110 forces the ASIC 130 into an alarm condition, generating an alarm 240. If the $CEV_{3NEW}$ is determined not to be less than the $CEV_{ALARM}$ value, the microprocessor determines if the $CEV_{2PREV}>CEV_{2NEW}>CEV_{ALARM}$ 1165. If the $CEV_{2PREV}>CEV_{2NEW}>CEV_{ALARM}$, the microprocessor 110 records the decreasing $CEV_{2PREV}$ for this cycle and increments a CEV decreasing cycle counter 1123 or similar record.

If the microprocessor 110 senses a decreasing trend of $CEV_{2NEW}$ readings, evidenced by the $CEV_{2NEW}$ decreasing for seven consecutive cycles 1124, the microprocessor 110 infers a smoldering fire, selects and employs a lower alarm threshold differential value, $CEV_{DELTA2}$=200 mV, 1140 to enhance the ionization detector's sensitivity. In other embodiments the decreasing trend of consecutive $CEV_{2NEW}$ readings necessary to cause a threshold shift may be as few as three consecutive decreasing readings for $CEV_2$.

If the $CEV_{2PREV}\leqq CEV_{2NEW}>CEV_{ALARM}$, the microprocessor 110 continues to use the standard alarm threshold differential value, $CEV_{DELTA1}$=900 mV, to maintain resistance to nuisance false alarms 1175. If the $CEV_{2NEW}$ does not reflect a continuous decrease at any point after selecting a $CEV_{DELTA}$ to enhance the detector's smoldering event sensitivity, the decreasing cycle counter is reset to one 1153, and the microprocessor reverts back to the standard alarm threshold differential value, $CEV_{DELTA1}$=900 mV 1175, which provides optimized detection of the traditional fast flaming fires.

In other embodiments the optimization of alarm thresholds, via preprocessing of the sensor package's output and optimizing the microprocessor's signal processing comparisons, as well as the energy conservation features set forth herein, may be employed to optimize the performance of other hazardous condition detectors such as photoelectric or gas detectors. This optimization technology may be employed to improve the efficiency of stand alone detectors and/or interconnected hazardous condition detection systems employed in residential and industrial structures or other enclosed environments.

The invention claimed is:

1. A hazardous condition detection system, comprising, a housing containing a sensor package, the sensor package containing a hazardous condition sensor, the hazardous condition sensor being exposed to the ambient environment and taking periodic readings of the ambient environment;

an alarm circuit coupled to the sensor package and disposed in the housing;

a microprocessor coupled to the alarm circuit, the microprocessor having a memory storage device containing a clean air reading and a plurality of alarm thresholds differential values, each of the plurality of alarm thresholds differential values being associated with a predetermined set of sensor readings indicative of a hazardous condition in the ambient environment, where said microprocessor periodically receives a raw sensor reading from the sensor package and preprocesses said received raw sensor reading using at least three distinctive filtering constants to generate a set of at least three conditioned sensor readings from each raw sensor reading received and where said microprocessor accumulates a plurality of sets of conditioned sensor readings, and selects an alarm threshold differential value from a plurality of stored alarm thresholds differential values based on the rate of change of the conditioned sensor readings in a first subset of accumulated conditioned sensor readings generated from a common filtering constant, and generates an alarm threshold from the selected alarm threshold differential value.

2. The hazardous detection system of claim 1 characterized in that the microprocessor preprocesses each periodic sensor reading received from the sensor package according to the relation:

$$V_{xot}=1/N_x*\Sigma[N_x*V_o+(V_{it}-V_{xot-1})] \text{ from } t_n \text{ to } t,$$

where $V_{xot}$ is the new conditioned sensor reading, $N_x$ s a filtering constant, $V_o$ is the clean air reading, $V_{it}$ is the new raw sensor reading taken at time t, and $V_{xot-1}$ is the previously generated conditioned signal at time t-1.

3. The hazardous condition detection system of claim 2 characterized in that the hazardous condition sensor contained in the sensor package is a single ionization sensor.

4. The hazardous condition detection system of claim 3 characterized in that the sensor package contains includes a single ionization sensor with an ion chamber that is electrically coupled to (powered by) an output pin of the microprocessor coupled to the alarm circuit.

5. The hazardous condition detection system of claim 2 characterized in that the microprocessor preprocesses each periodic raw sensor reading received from the sensor package generating at least a set of $V_{1NEW}$, $V_{2NEW}$, and $V_{3NEW}$ conditioned sensor readings for each raw sensor reading received by the microprocessor from the sensor package by employing a $N_1$ constant of $2^{14}$, a $N_2$ constant of $2^7$, and a $N_3$ constant of $2^2$.

6. The hazardous condition detection system of claim 5 characterized in that the first subset of accumulated conditioned sensor readings is selected from the $V_{2NEW}$ conditioned sensor readings in the accumulated sets of conditioned sensor readings generated from the raw sensor readings (t from to $t_{-n}$).

7. The hazardous detection system of claim 2 characterized in that the microprocessor adjusts the value of the clean air reading to compensate for changes in the ambient conditions values based on the rate of change of the conditioned sensor readings in a second subset of accumulated conditioned sensor readings generated from a common filtering constant.

8. The hazardous detection system of claim 5 characterized in that the microprocessor generates a compensated alarm threshold by adjusting the value of the clean air reading based on the rate of change of the conditioned sensor readings in a second subset of accumulated conditioned sensor readings selected from the $V_{1NEW}$ conditioned sensor readings contained in the accumulated sets of conditioned sensor readings generated from t to $t\text{-}_n$.

9. The hazardous detection system of claim 5 characterized in that the microprocessor compares the generated alarm threshold with the $V_{3PREV}$ conditioned sensor reading and designates an alarm event if the $V_{3NEW}$ conditioned sensor reading violates the generated alarm threshold.

10. The hazardous detection system of claim 8 characterized in that the microprocessor compares the generated compensated alarm threshold with the $V_3$ conditioned sensor reading and designates an alarm event if the $V_3$ conditioned sensor reading violates the generated compensated alarm threshold.

11. A method for selecting an alarm threshold for a hazardous condition detector characterized by the method steps of:

associating a first alarm threshold differential value with a first predetermined set of ionization levels, and a second alarm threshold differential value with a second predetermined set of ionization levels;

generating a first alarm threshold value from the first alarm threshold differential value;

designating the first generated alarm threshold value as the current alarm threshold;

receiving periodic raw sensor readings of the ionization level in the ambient environment from a sensor package;

preprocessing each received periodic raw sensor reading and generating a set of conditioned sensor readings for each received periodic raw sensor reading;

accumulating a plurality of sets of conditioned sensor readings;

generating a first subset of conditioned sensor readings by selecting a first conditioned sensor reading from each of a plurality of accumulated sets of conditioned sensor readings;

generating a second subset of conditioned sensor readings by selecting a second conditioned sensor reading from each of a plurality of accumulated sets of conditioned sensor readings;

comparing the second subset of the conditioned sensor readings with the second predetermined set of ionization levels associated with the second alarm threshold differential value with a microprocessor;

if the second subset of conditioned sensor readings are within the ionization levels specified in the second predetermined set of ionization levels, selecting the second alarm threshold differential value, generating a second alarm threshold value from the selected second alarm threshold differential value, and designating the second alarm threshold value as the current alarm threshold;

comparing the current alarm threshold with a third conditioned sensor selected from the newest set of conditioned sensor readings; and designating an alarm event if the third conditioned sensor reading is in violation of the current alarm threshold.

12. The method according to claim 11 further characterized by the step of:

designating the first alarm threshold value as the current alarm threshold if the newest conditioned sensor readings from the second subset of conditioned sensor readings is less than the current alarm threshold value but greater than or equal to the preceding conditioned sensor reading in the second subset.

13. The method according to claim 12 further characterized by the steps of:

associating a third alarm threshold differential value with a third predetermined set of ionization levels;

comparing the second subset of the conditioned sensor readings with the third predetermined set of ionization levels associated with the third alarm threshold differential value with a microprocessor;

if the conditioned sensor readings in the second subset are within the ionization levels specified in the third predetermined set of ionization levels associated with the third alarm threshold, selecting the third alarm threshold differential value, generating a third alarm threshold value from the selected third alarm threshold differential value, and designating the third alarm threshold value as the current alarm threshold.

14. The method according to claim 12 further characterized by the step of:

preprocessing each periodic sensor reading received from the sensor package according to the relation:

$$V_{xot}=1/N_x*\Sigma[N_x*V_o+(V_{it}-V_{xot-1})] \text{ from } t_{-n} \text{ to } t,$$

where $V_{xot}$ is the new conditioned sensor reading, $N_x$ is a filtering constant, $V_o$ is the clean air reading, $V_{it}$ is the new raw sensor reading taken at time t, and $V_{xot-1}$ is the previously generated conditioned signal at time t-1.

15. The method according to claim 14 characterized by the step of preprocessing each periodic raw sensor reading received from the sensor package generating at least a set of $V_{1NEW}$, $V_{2NEW}$, and $V_{3NEW}$ conditioned sensor readings for each raw sensor reading received by the microprocessor from the sensor package by employing a $N_1$ constant of $2^{14}$, a $N_2$ constant of $2^7$, and a $N_3$ constant of $2^2$.

16. The method according to claim 15 characterized by the step of selecting the first subset of accumulated conditioned sensor readings from the $V_2$ conditioned sensor readings in the accumulated sets of conditioned sensor readings generated from the raw sensor readings (from $t_n$ to t).

17. The method according to claim 14 characterized by the step of adjusting the generated alarm threshold to compensate for changes in the ambient conditions values based on the rate of change of the conditioned sensor readings in a second subset of accumulated conditioned sensor readings generated from a common filtering constant.

18. The method according to claim 15 characterized by the step of generating a compensated alarm threshold by using a microprocessor to adjust the value of the generated alarm threshold based on the rate of change of the conditioned sensor readings in a second subset of accumulated conditioned sensor readings selected from the $V_{1NEW}$ conditioned sensor readings in the accumulated sets of conditioned sensor readings generated from the raw sensor readings (from $t_n$ to t) and comparing the $V_{3NEW}$ conditioned sensor reading with the $V_{3PREV}$ and designating an alarm event if the generated alarm threshold has been violated.

19. The method according to claim 11 further characterized by the step of:

conditioning each ionization reading received by removing a selected amount of noise and attenuation therefrom.

20. The method according to claim 19 further characterized by the step of:

conditioning each raw sensor reading received by removing a selected amount of noise and attenuation therefrom, and generating a conditioned sensor reading according to the relation:

$$V_{xot}=1/N_x*\Sigma[N_x*V_o+(V_{it}-V_{xot-1})] \text{ from } t_{-n} \text{ to } t,$$

where $V_{xot}$ is the new conditioned sensor reading, $N_x$ is a filtering constant, $V_o$ is the clean air reading, $V_{it}$ is the new raw sensor reading taken at time t, and $V_{xot-1}$ is the previously generated conditioned signal at time t-1 and each of said plurality of filtering constants is selected by the microprocessor to generate a set of conditioned readings each having a signal to noise ratio optimized for a particular processing step.

* * * * *